US008879948B2

(12) United States Patent
Itabashi

(10) Patent No.: US 8,879,948 B2
(45) **Date of Patent: *Nov. 4, 2014**

(54) TONER CARTRIDGE

(75) Inventor: Nao Itabashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 545 days.

This patent is subject to a terminal disclaimer.

(21) Appl. No.: 13/073,371

(22) Filed: Mar. 28, 2011

(65) Prior Publication Data

US 2012/0033988 A1 Feb. 9, 2012

(30) Foreign Application Priority Data

Aug. 3, 2010 (JP) ..... 2010-174483
Sep. 7, 2010 (JP) ..... 2010-200190

(51) Int. Cl.
*G03G 15/08* (2006.01)

(52) U.S. Cl.
CPC .... *G03G 15/0834* (2013.01); *G03G 2215/0692* (2013.01); *G03G 2215/067* (2013.01); *G03G 15/0886* (2013.01)
USPC ..... 399/106; 399/101; 399/102; 399/103; 399/105; 399/258; 399/260; 399/262

(58) Field of Classification Search
USPC ..... 399/101, 102, 105, 106, 258, 262
See application file for complete search history.

(56) References Cited

U.S. PATENT DOCUMENTS

| | | | | |
|---|---|---|---|---|
| 4,937,628 | A | 6/1990 | Cipolla et al. | |
| 5,608,501 | A | 3/1997 | Makino | |
| 6,091,920 | A | 7/2000 | Kita et al. | |
| 6,185,401 | B1 | 2/2001 | Kanamori et al. | |
| 8,090,302 | B2 | 1/2012 | Koshimori et al. | |
| 8,204,402 | B2 | 6/2012 | Yoshizawa et al. | |
| 2008/0267658 | A1 | 10/2008 | Takagi et al. | |
| 2009/0087215 | A1* | 4/2009 | Sakuma | 399/105 |
| 2009/0129828 | A1 | 5/2009 | Koshimori et al. | |
| 2009/0158667 | A1 | 6/2009 | Yoshizawa et al. | |
| 2010/0272465 | A1* | 10/2010 | Yamazaki | 399/106 |

FOREIGN PATENT DOCUMENTS

| | | |
|---|---|---|
| EP | 0905577 A2 | 3/1999 |
| JP | 01-219865 | 9/1989 |
| JP | 07-225514 | 8/1995 |
| JP | 08-292635 | 11/1996 |

(Continued)

OTHER PUBLICATIONS

Extended Search Report received in corresponding EP Application No. 12 17 9255 mailed Oct. 31, 2012.

(Continued)

*Primary Examiner* — David Gray
*Assistant Examiner* — Michael Harrison
(74) *Attorney, Agent, or Firm* — Banner & Witcoff, Ltd.

(57) ABSTRACT

A toner cartridge, a main casing accommodates therein toner and is formed with an opening which provides communication between an interior and an exterior of the main casing. A shutter is movable along the main casing by an external driving force applied in a force direction between a closed position at which the shutter closes the opening and an open position at which the shutter opens the opening. A toner seal is formed with a seal opening opposing the opening of the main casing, and interposed between the main casing and the shutter when the shutter is positioned at the closed position. A guide portion is configured to guide a movement of the shutter in an inclined direction inclined with respect to the force direction.

23 Claims, 35 Drawing Sheets

(56) References Cited

FOREIGN PATENT DOCUMENTS

| | | | |
|---|---|---|---|
| JP | 09-043982 | | 2/1997 |
| JP | 11-084838 | | 3/1999 |
| JP | 11-282233 | | 10/1999 |
| JP | 2004-101789 | | 4/2004 |
| JP | 2005-274862 | | 10/2005 |
| JP | 2006-243763 | A | 9/2006 |
| JP | 2007-333875 | | 12/2007 |
| JP | 2008-275874 | | 11/2008 |
| JP | 2009-122545 | A | 6/2009 |
| JP | 2009-205126 | A | 9/2009 |

OTHER PUBLICATIONS

Notification of First Office Action issued in corresponding Chinese Patent Application No. 201110083687.6 dated Jan. 14, 2013.

Office Action for corresponding Japanese Patent Application No. 2010-174483 dated May 22, 2012.

Extended European search report for application No. 11160406.2 mailed Nov. 14, 2011.

Notification of Third Office Action issued in corresponding Chinese Patent Application No. 201110083687.6 mailed Feb. 13, 2014.

Office Action in corresponding Japanese Patent Application No. 2010-174483 mailed Apr. 2, 2013.

Notification of the Second Office Action issued in corresponding Chinese Patent Application No. 201110083687.6 issued Aug. 21, 2013.

* cited by examiner

TONER CARTRIDGE

CROSS REFERENCE TO RELATED APPLICATION

This application claims priority from Japanese Patent Application No. 2010-174483 filed Aug. 3, 2010 and Japanese Patent Application No. 2010-200190 filed Sep. 7, 2010. The entire contents of the priority applications are incorporated herein by reference.

TECHNICAL FIELD

The invention relates to a toner cartridge and a developing device provided in an image-forming device, such as a laser printer.

BACKGROUND

Some conventional image-forming devices, such as laser printers, are provided with a photosensitive drum, a developing device, and a toner box mounted on the case of the developing device for accommodating toner.

The toner box has an arc-shaped peripheral surface, for example, with a toner outlet formed in the arc-shaped peripheral surface for discharging toner into the developing device. A sealing member is provided around the toner outlet to prevent toner from leaking through gap between the toner box and the developing device. A shutter is slidably disposed on the outside of the arc-shaped peripheral surface for opening and closing the toner outlet.

After the toner box is mounted on the case of the developing device, the toner outlet is opened by sliding the shutter to a position not opposing the toner outlet. This operation forms a toner supply channel between the toner box and the developing device through the toner outlet, and toner in the toner box can be supplied to the developing device through the toner supply channel.

In an image-forming operation, the conventional image-forming device having the structure described above forms an electrostatic latent image on the surface of the photosensitive drum. A developing unit of the developing device develops the latent image into a toner image. When the toner box runs out of toner as the toner is consumed in image-forming operations, an operator removes this toner box from the case of the developing device and mounts a new toner box in its place.

Before the operator removes the toner box from the case of the developing device, the operator slides the shutter to a position opposing the toner outlet so that the shutter closes the toner outlet. In this state, the shutter contact the sealing members with pressure, and the sealing members seal the gap between the shutter and the periphery of the toner outlet. Hence, this construction prevents toner in the toner box from leaking out through gap formed around the toner outlet after the toner box has been removed from the case of the developing device.

SUMMARY

However, when the operator moves the shutter from a position exposing the toner outlet to a position opposing and closing the toner outlet, the edge of the shutter on the downstream side with respect to the direction of movement can catch on the sealing members, inhibiting smooth operation of the shutter. In some cases, the edge of the shutter catching on the sealing members may hinder smooth operation of the shutter, as well as causing damage to the shutter, sealing members, or both.

Therefore, it is an object of the invention to provide a toner cartridge capable of ensuring smooth operation of the shutter.

Further, in order to prevent toner from leaking when transporting a toner box, it is necessary for the shutter to contact the sealing members with a sufficiently high pressure. However, increasing the sealing pressure of the sealing members increases the torque required to move the shutter, thereby reducing operating efficiency of the shutter.

Therefore, it is an object of the invention to provide a toner cartridge capable of preventing toner from leaking during transport, while reducing the torque required for operating the shutter. It is another object of the invention to provide an image-forming device employing this toner cartridge.

In order to attain the above and other objects, the invention provides a toner cartridge. The toner cartridge includes a main casing, a shutter, a toner seal, and a guide portion. The main casing accommodates therein toner and is formed with an opening which provides communication between an interior and an exterior of the main casing. The shutter is movable along the main casing by an external driving force applied in a force direction between a closed position at which the shutter closes the opening and an open position at which the shutter opens the opening. The toner seal is formed with a seal opening opposing the opening of the main casing, and interposed between the main casing and the shutter when the shutter is positioned at the closed position. The guide portion is configured to guide a movement of the shutter in an inclined direction inclined with respect to the force direction.

According to another aspect, the invention provides a developing device including a toner cartridge, and a developing unit to which the toner cartridge is assembleable. The toner cartridge includes a main casing, a shutter, a toner seal, and a shutter cover. The main casing accommodates therein toner and is formed with an opening which provides communication between an interior and an exterior of the main casing. The shutter has an engaged portion and is movable along the main casing between a closed position at which the shutter closes the opening and an open position at which the shutter opens the opening. The toner seal is formed with a seal opening opposing the opening of the main casing, and is interposed between the main casing and the shutter when the shutter is positioned at the closed position. The shutter cover is configured to cover the shutter and is positioned opposite to the main casing with respect to the shutter, the shutter cover being formed with a guide hole having an inclined portion. The developing unit includes a shutter drive member configured to move the shutter between the open position and the closed position, and having an engaging portion engageable with the engaged portion. The engaging portion extends through the guide hole to engage the engaged portion and defines a direction of a force transmitted to the engaged portion. The inclined portion is inclined with respect to the direction of the force.

According to another aspect, the invention provides a developing device including a toner cartridge, and a developing unit to which the toner cartridge is assembleable. The toner cartridge includes a main casing, a shutter, and a toner seal. The main casing accommodates therein toner and is formed with an opening which provides communication between an interior and an exterior of the main casing. The shutter has an engaged portion and movable along the main casing between a closed position at which the shutter closes the opening and an open position at which the shutter opens the opening. The toner seal is formed with a seal opening opposing the opening of the main casing, and interposed between the main casing and the shutter when the shutter is positioned at the closed position. The developing unit includes a shutter drive member, and a guide member. The shutter drive member is configured to move the shutter between the open position and the closed position, and has an engaging portion engageable with the engaged portion. The engaging portion defines a direction of a force transmitted to the engaged portion. The guide member has an inclined portion in abutment with the shutter drive member to guide a movement of the shutter drive member in a direction inclined with respect to the direction of force.

According to still another aspect, the invention provides a toner cartridge. The toner cartridge includes a main casing, a shutter, a toner seal, and a shutter cover. The main casing accommodates therein toner and formed with an opening which provides communication between an interior and an exterior of the main casing. The shutter is configured to move between a closed position at which the shutter closes the opening and an open position at which the shutter opens the opening. The toner seal is interposed between the main casing and the shutter when the shutter is positioned at the closed position. The shutter cover is positioned opposite to the main casing with respect to the shutter for covering the shutter and movable between a first position and a second position while the shutter is at the closed position, the shutter cover compressing the toner seal toward the main casing, and providing, at the second position, a compression amount of the toner seal greater than that at the first position.

According to still another aspect, the invention provides an image-forming device. The image-forming device includes a main frame body, a holder unit, and a toner cartridge. The main frame body defines an accommodation space. The holder unit is configured to move between an accommodated position at which the holder unit is accommodated in the accommodation space and a pulled-out position in which the holder unit is displaced from the accommodated position. The toner cartridge is mountable on the holder unit. The toner cartridge includes a main casing, a shutter, a toner seal, and a shutter cover. The main casing accommodates therein toner and formed with an opening which provides communication between an interior and an exterior of the main casing. The shutter is configured to move between a closed position at which the shutter closes the opening and an open position at which the shutter opens the opening. The toner seal is interposed between the main casing and the shutter when the shutter is positioned at the closed position. The shutter cover is positioned opposite to the main casing with respect to the shutter for covering the shutter and movable between a first position and a second position while the shutter is at the closed position. The shutter cover compresses the toner seal toward the main casing, and providing, at the second position, a compression amount of the toner seal greater than that at the first position.

BRIEF DESCRIPTION OF THE DRAWINGS

The particular features and advantages of the invention as well as other objects will become apparent from the following description taken in connection with the accompanying drawings, in which.

DETAILED DESCRIPTION

[First Embodiment]

1-1. Color Printer

Figure 1:
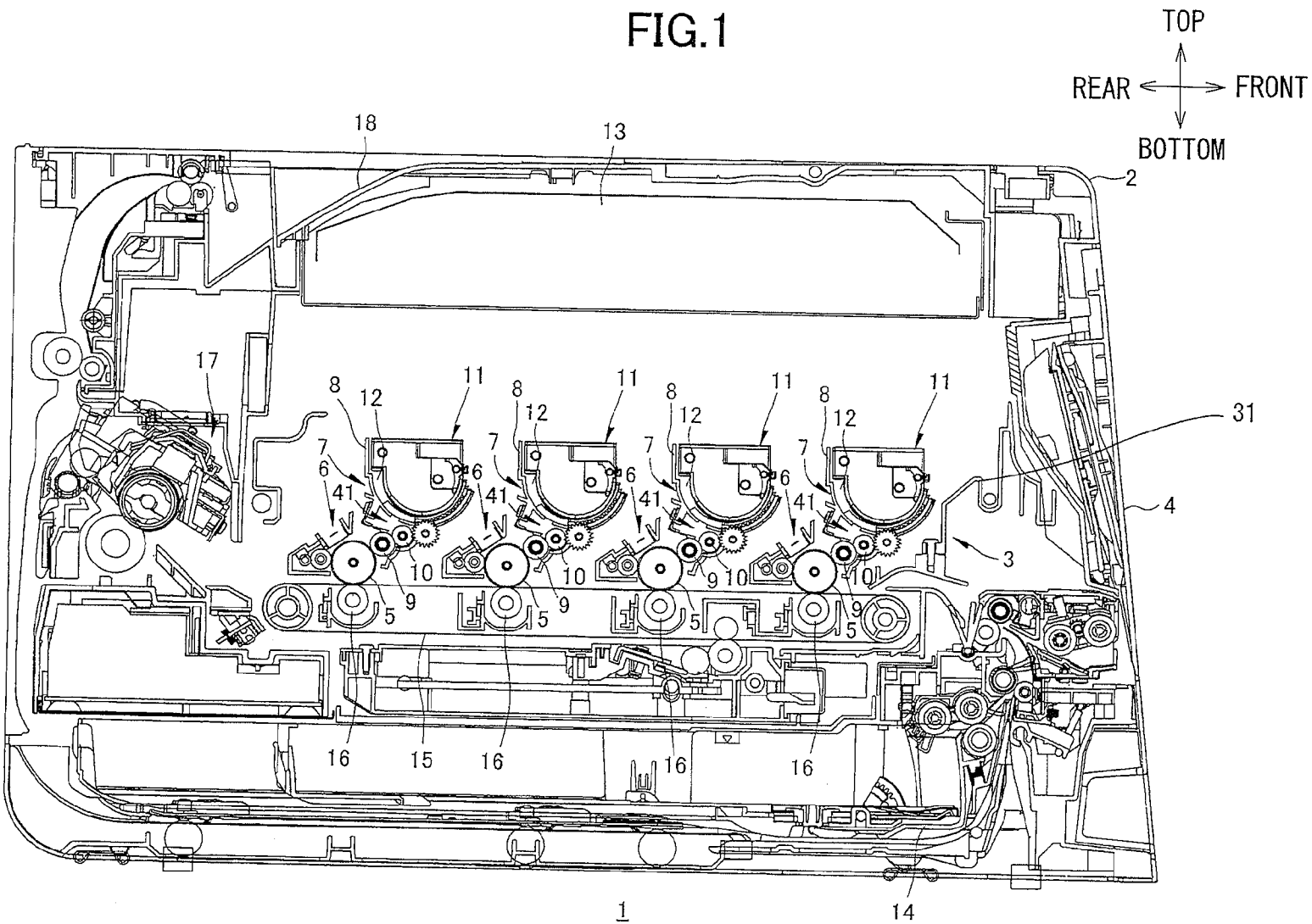
FIG. 1 is a cross section of a color printer according to a first embodiment.

As shown in FIG. 1, the image-forming device according to the first embodiment is a tandem-type color printer 1. The color printer 1 includes a main casing 2. A drawer unit 3 is mounted inside the main casing 2. A front cover 4 is provided on the front surface of the main casing 2 and is capable of being opened and closed thereon. When the front cover 4 is open, the drawer unit 3 can be moved horizontally between an accommodated position inside the main casing 2 (the position shown in FIG. 1) and a withdrawn position outside the main casing 2. In the withdrawn position, part of the drawer unit 3 remains inside the main casing 2, while the top of the drawer unit 3 outside the main casing 2 is exposed to reveal four toner cartridges 11 (described later) mounted therein.

In the following description, the side of the color printer 1 on which the front cover 4 is provided (right side in FIG. 1) will be referred to as the front side of the color printer 1 (the side that the user normally faces). The top, bottom, left, and right sides of the color printer 1 in the following description will be based on the reference point of a user viewing the color printer 1 from the front side. Similarly, directions related to the drawer unit 3 and the toner cartridges 11 (described later) mounted in the drawer unit 3 will be referenced based on their positions when mounted in the main casing 2.

As shown in FIG. 1, four photosensitive drums 5 are rotatably retained in the drawer unit 1 The photosensitive drums 5 are capable of rotating about axes extending in the left-to-right direction. The four photosensitive drums 5 are respectively provided for the colors black, yellow, magenta, and cyan and are arranged parallel to each other at regular intervals in the front-to-rear direction according to the order of colors given above.

Four chargers 6 are also retained in the drawer unit 3. The chargers 6 have a one-on-one correspondence to the four photosensitive drums 5 and are disposed at positions diagonally above and rearward from the corresponding photosensitive drums 5. Each charger 6 is a Scorotron charger that includes a discharge wire and grid, for example.

Four developing units 7 are also retained in the drawer unit 3. The four developing units 7 also have a one-on-one correspondence to the four photosensitive drums 5 and are disposed diagonally above and forward of the corresponding photosensitive drums 5.

Each developing unit 7 includes a developing unit frame 8. A developing roller 9 and a supply roller 10 rotatably are supported in the developing unit frame 8.

Each developing roller 9 is disposed in contact with the corresponding photosensitive drum 5 and is capable of rotating about an axis extending in the left-to-right direction.

Each supply roller 10 is disposed so as to contact the corresponding developing roller 9 from a position above and forward of the same and is capable of rotating about an axis extending in the left-to-right direction.

A space 12 is provided in the drawer unit 3 above each developing unit 7. A toner cartridge 11 that accommodates toner is mounted in the space 12 formed above each developing unit 7. The toner cartridges 11 are mounted from above the drawer unit 3 into the corresponding spaces 12 while the drawer unit 3 has been pulled outward to the withdrawn position. The toner cartridges 11 supply toner to the corresponding developing units 7.

An exposure device 13 is provided in the main casing 2 above the drawer unit 3. The exposure device 13 irradiates four laser beams corresponding to the four colors used by the color printer 1.

As each photosensitive drum 5 rotates, the corresponding charger 6 applies a uniform charge to the surface of the photosensitive drum 5 through corona discharge. Subsequently, the exposure device 13 irradiates laser beams for selectively exposing the surfaces of the photosensitive drums 5. This exposure selectively removes charge from the surfaces of the photosensitive drums 5, forming electrostatic latent images thereon. When the electrostatic latent image carried on the surface of a photosensitive drum 5 rotates to a position opposite the corresponding developing roller 9, the developing roller 9 supplies toner to the latent image, developing the image into a toner image.

Here, four LED arrays may be provided for the four photosensitive drums 5 in place of the exposure device 13.

A paper cassette 14 accommodating sheets of a paper P is disposed in a bottom section of the main casing 2. The paper P accommodated in the paper cassette 14 is conveyed onto a conveying belt 15 by various rollers. The conveying belt 15 is disposed so that an upper portion of the conveying belt 15 confronts the four photosensitive drums 5 from below. Four transfer rollers 16 are disposed inside the conveying belt 15 at positions confronting each of the photosensitive drums 5 through the upper portion of the conveying belt 15. When a sheet of paper P is conveyed onto the conveying belt 15, the conveying belt 15 carries the sheet sequentially through positions between the conveying belt 15 and each of the photosensitive drums 5. As the sheet passes beneath each photosensitive drum 5, the toner image carried on the surface of the photosensitive drum 5 is transferred onto the paper P.

A fixing unit 17 is provided on the downstream side of the conveying belt 15 with respect to the direction that the paper P is conveyed. After toner images are transferred onto a sheet of paper P, the sheet is conveyed to the fixing unit 17, where the toner images are fixed to the sheet by heat and pressure. After the toner images are fixed in the fixing unit 17, various rollers discharge the sheet onto a discharge tray 18 formed on the top surface of the main casing 2.

1-2. Developing Units

As shown in FIG. 1, the drawer unit 3 has a drawer frame 31 that is square-shaped in a plan view. The drawer frame 31 includes a pair of side plates arranged parallel to each other and separated in the left-to-right direction. The respective groups of four photosensitive drums 5, chargers 6, and developing units 7 are all held between the side plates of the drawer frame 31 on the left and right sides thereof.

The developing units 7 are retained in the drawer frame 31 such that the developing unit frames 8 of the developing units 7 are spaced at regular intervals in the front-to-rear direction. One of the spaces 12 is allocated above each of the developing unit frames 8 for mounting the corresponding toner cartridge 11.

A developing chamber 41 is formed in each developing unit frame 8 for accommodating the respective developing roller 9. The side of the developing chamber 41 opposing the corresponding photosensitive drum 5 is open. The developing roller 9 is disposed in the bottom of the developing chamber 41 near the open side thereof.

Figure 2:
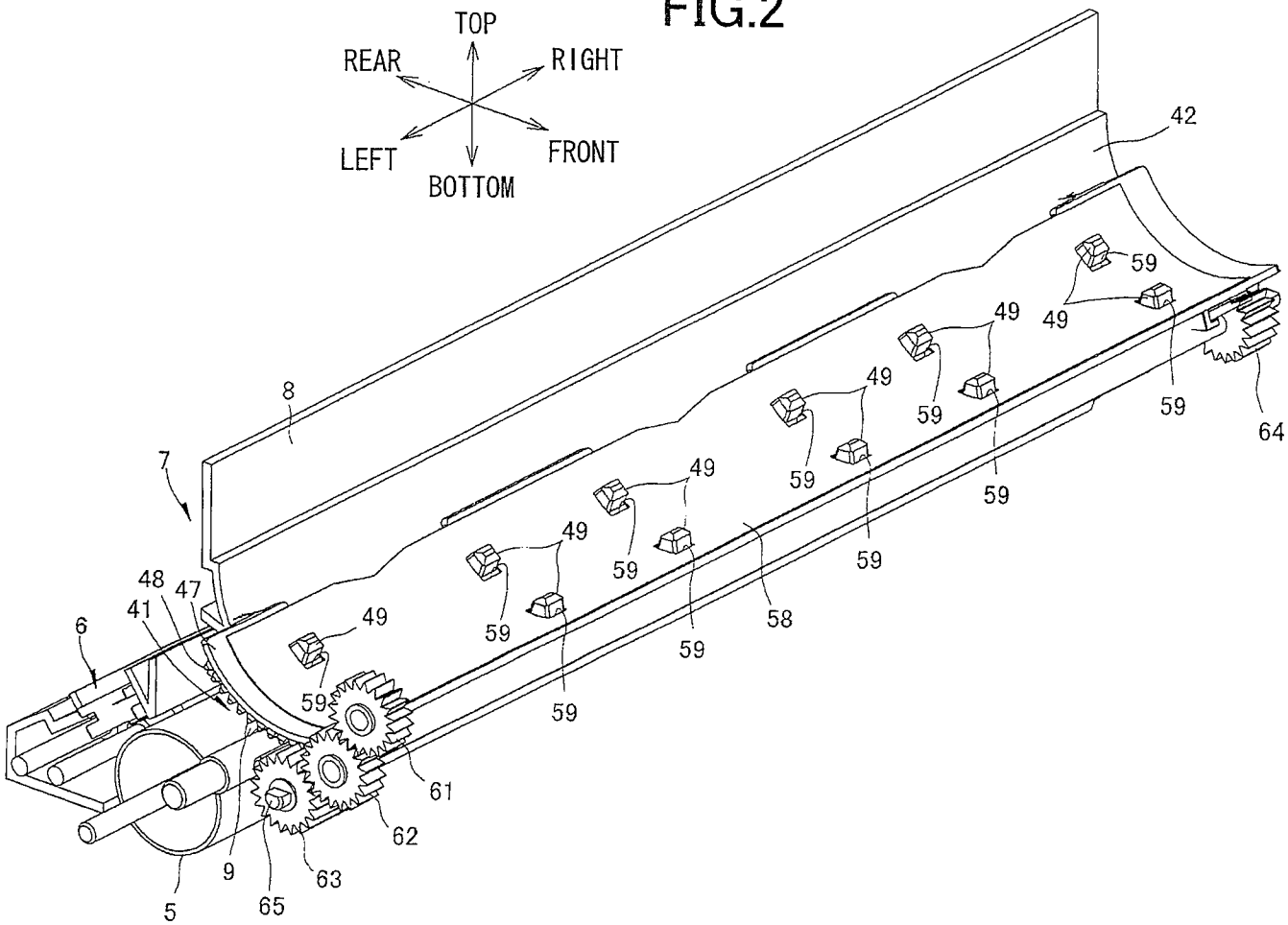
FIG. 2 is a perspective view of a photosensitive drum, a charger, a developing unit with a thorough-hole closed.
Figure 3:
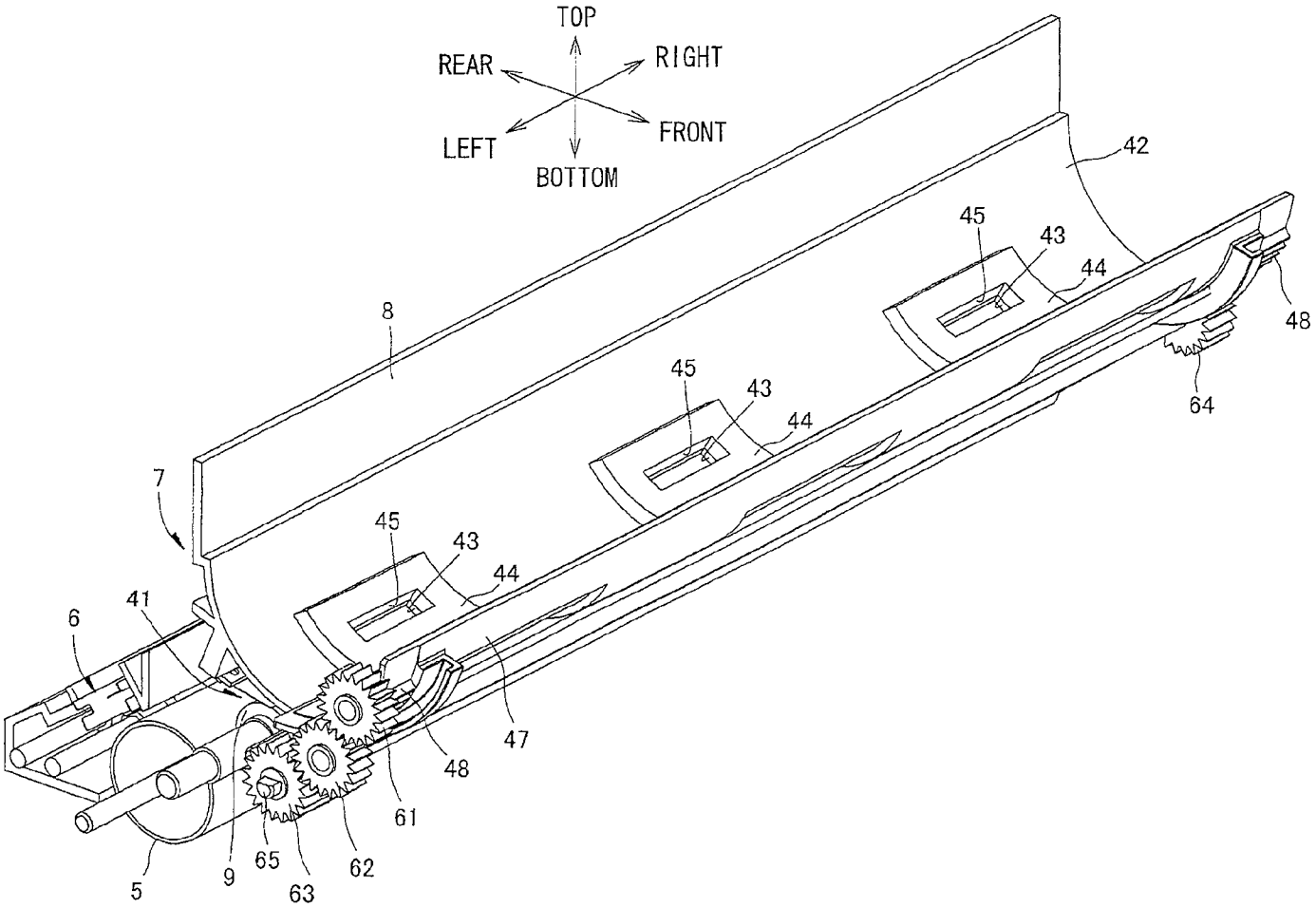
FIG. 3 is perspective view of the photosensitive drum, the charger, the developing unit with the through-hole opened.

As shown in FIGS. 2 and 3, the developing unit frame 8 also has a plate-shaped partitioning wall 42 positioned between the developing chamber 41 and the space 12. The partitioning wall 42 curves in an are shape, with its convex side facing the developing chamber 41. The partitioning wall 42 partitions the interior of the developing unit frame 8 into the developing chamber 41 and the space 12 formed above the developing chamber 41.

As shown in FIG. 3, three rectangular through-holes 43 are formed in the circumferential center of the partitioning wall 42. The through-holes 43 are formed at positions opposing three through-holes 53 (described later with reference to FIG. 5) formed in the toner cartridge 11 when the toner cartridge 11 is mounted in the space 12.

As shown in FIG. 3, three frame seals 44 are disposed on top of the partitioning wall 42. The frame seals 44 are affixed to the partitioning wall 42 at positions corresponding to the through-holes 43. The frame seals 44 are rectangular sheet-like seals formed of an elastic foam material. A seal opening 45 is formed in the center region of each frame seal 44. The seal opening 45 penetrates the corresponding frame seal 44 in the thickness direction and is in communication with the corresponding through-hole 43.

1-3. Shutter Drive Member

As shown in FIGS. 2 and 3, a shutter drive member 47 is movably disposed above the partitioning wall 42. The shutter drive member 47 can move in forward and rearward directions, and left and right directions, for driving a shutter 58 described later. The shutter drive member 47 is formed of a plate curved in an arc shape that substantially conforms to the partitioning wall 42, with the convex side facing the developing chamber 41. The shutter drive member 47 is elongated in the left-to-right direction, with both left and right ends of the shutter drive member 47 protruding farther outward than the left and right ends of the partitioning wall 42. Rack gears 48 are formed on the bottom surface of the shutter drive member 47, on the left and right end portions protruding from the partitioning wall 42. Shutter drive protrusions 49 (FIG. 2) are formed on the top surface of the shutter drive member 47 at positions corresponding to shutter drive openings 59 described later.

FIG. 2 shows the state of a shutter 58, described later, when assembled with the shutter drive member 47.

1-4. Toner Cartridges (1) Case

Figure 4:
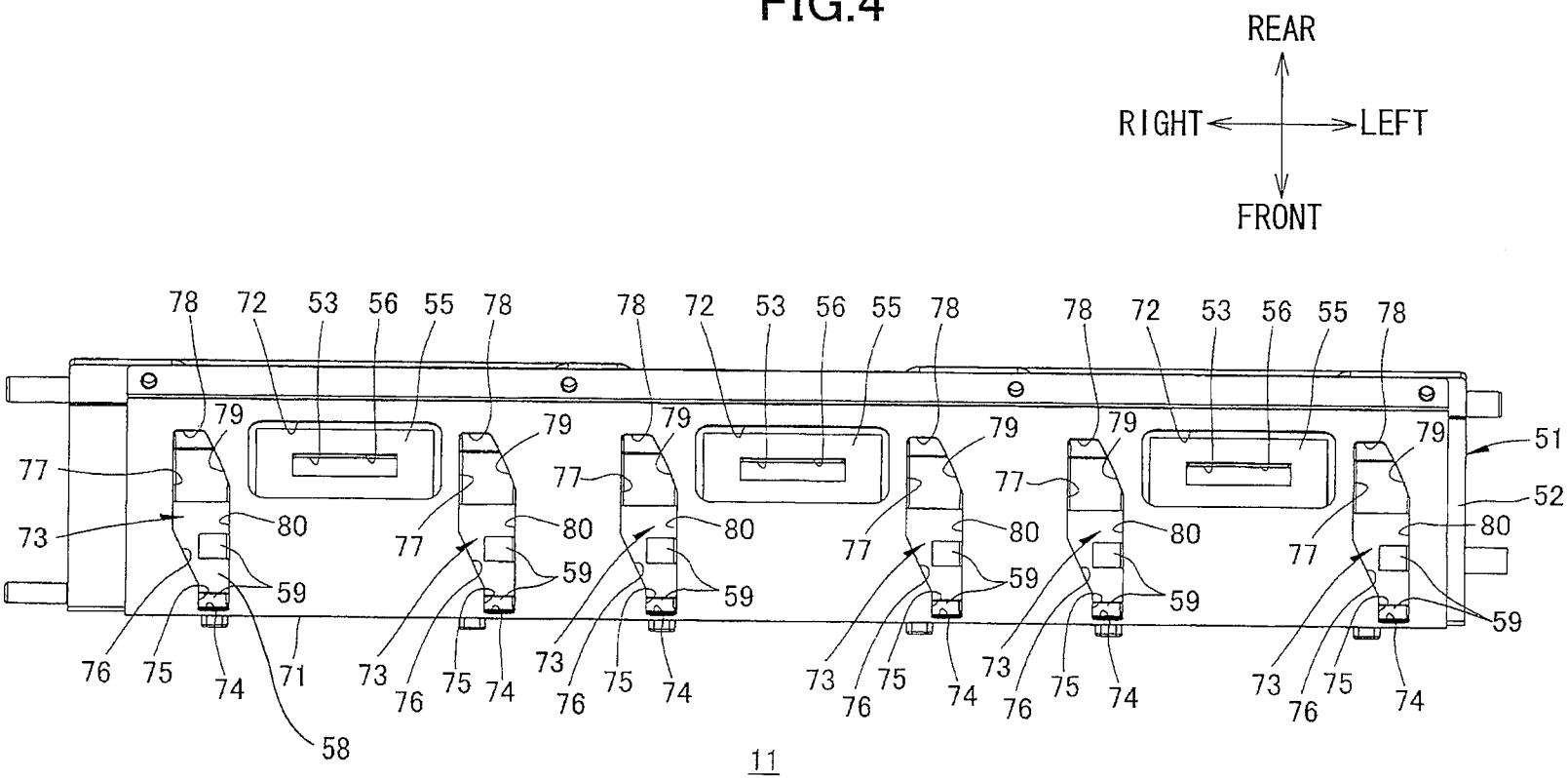
FIG. 4 is a bottom view illustrating a toner cartridge when a shutter is in an open position.

As shown in FIG. 4, the toner cartridge 11 includes a case 51 for accommodating toner. The case 51 is formed of a resin material in a substantially hollowed-out semicircular column shape and is elongated in the left-to-right direction. The case 51 includes an arcing surface 52 having a substantially semicircular arc shape in cross section, with the convex side facing downward.

Figure 5:
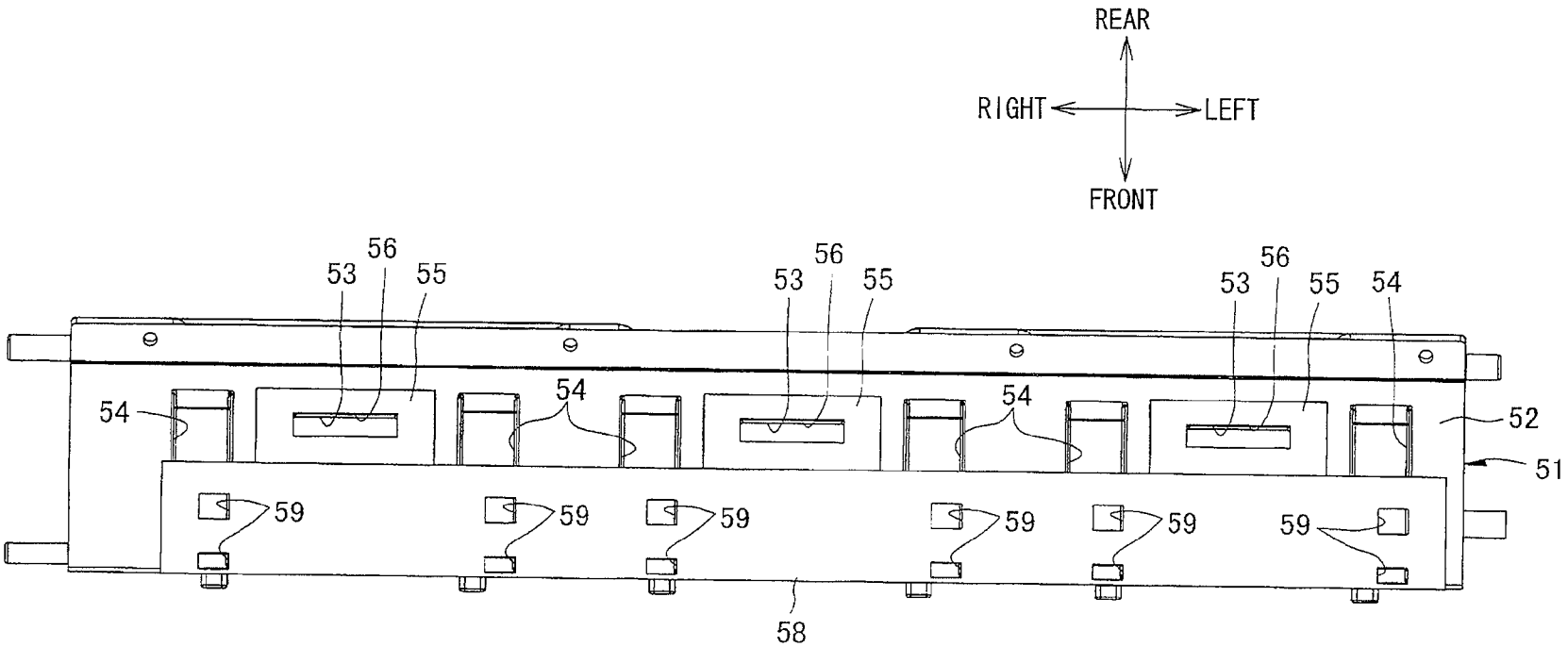
FIG. 5 is a bottom view illustrating the toner cartridge when a shutter cover is removed.

As shown in FIGS. 4 and 5, three through-holes 53 are formed in the arcing surface 52 of the case 51 at rear positions of the bottom portion of the arcing surface 52. The through-holes 53 are rectangular in shape and elongated in the left to right direction, and are spaced at intervals in the left-to-right direction. The through-holes 53 provide fluid communication between the interior and exterior of the case 51.

As shown in FIG. 5, relief grooves 54 are also formed in the arcing surface 52. The relief grooves 54 extend in the peripheral direction of the arcing surface 52 and are formed one on each of the left and right sides of each through-hole 53.

(2) Toner Seals

Three toner seals 55 are affixed to the arcing surface 52 of the case 51. One of the toner seals 55 is provided around each of the through-holes 53. The toner seals 55 have a rectangular sheet-like shape and are formed of an elastic foam material. A seal opening 56 is formed in the center region of each toner seal 55. The seal openings 56 penetrate the toner seals 55 in the thickness direction and are in communication with the corresponding through-holes 53.

(3) Shutter Cover

As shown in FIG. 4, a shutter cover 71 is disposed so as to cover the arcing surface 52 of the case 51. The shutter cover 71 is formed of a flexible thin metal plate, for example, and is curved to conform to the arcing surface 52 of the case 51. Both the front and rear edges of the shutter cover 71 are fixed to the case 51. The left-to-right dimension of the shutter cover 71 is approximately equal to the same dimension of the arcing surface 52, so that the shutter cover 71 covers the arcing surface 52 across substantially the entire width in the left-to-right direction.

Openings 72 are formed in the shutter cover 71 at positions corresponding to the toner seals 55. Each of the openings 72 has a rectangular shape and is elongated in the left-to-right direction. The openings 72 have a greater open area than the area of the corresponding through-holes 53, thereby exposing the through-holes 53 in their entirety, as well as a portion of the toner seals 55 around the through-holes 53.

Guide slits 73 (thorough holes) are formed in the shutter cover 71 at positions corresponding to the relief grooves 54 formed in the case 51. Each guide slit 73 is configured of a front edge 74 extending in the left-to-right direction, a first right edge 75 extending slightly rearward from the right end of the front edge 74 along the circumferential direction of the shutter cover 71, a second right edge 76 extending rearward from the rear end of the first right edge 75 while sloping rightward relative to the circumferential direction of the shutter cover 71, a third right edge 77 extending rearward from the rear end of the second right edge 76 along the circumferential direction of the shutter cover 71, a rear edge 78 extending leftward from the rear end of the third right edge 77, a first left edge 79 extending forward from the left end of the rear edge 78 while sloping leftward relative to the circumferential direction of the shutter cover 71, and a second left edge 80 extending along the circumferential direction of the shutter cover 71 between the front end of the first left edge 79 and the left end of the front edge 74. The front edge 74 and the rear edge 78 have lengths substantially equivalent to the left-to-right dimension of the shutter drive protrusions 49 constituting the shutter drive member 47. Further, the second right edge 76 and the first left edge 79 are parallel.

(4) Shutter

As shown in FIG. 4, a shutter 58 is disposed between the arcing surface 52 of the case 51 and the shutter cover 71. (In FIG. 2, the shutter cover 71 is abbreviated for illustrative purpose.) The shutter 58 can move along the arcing surface 52 between an open position and a closed position. The shutter 58 is formed of a resin film that is curved to conform to the arcing surface 52. The shorter dimension (circumferential dimension) of the shutter 58 along the arcing surface 52 is greater than the same dimension of the toner seal 55, while the left-to-right dimension (width) of the shutter 58 is slightly smaller than the left-to-right dimension of the arcing surface 52.

Two shutter drive openings 59 separated by a prescribed interval in the circumferential direction of the shutter 58 are formed in the shutter 58 at positions opposing each of the relief grooves 54 in the case 51. The distance between shutter drive openings 59 in each pair aligned in the circumferential direction of the shutter 58 is set such that all shutter drive openings 59 confront a corresponding relief groove 54 and confront and communicate with a corresponding guide slit 73 formed in the shutter cover 71, regardless of whether the shutter 58 is in the open position or the closed position.

When the shutter 58 is in the open position, the rear edge of the shutter 58 is positioned farther forward than the front edges of the seal openings 56 formed in the toner seals 55. Therefore, the through-holes 53 formed in the case 51 and the seal openings 56 formed in the toner seals 55 are open and in communication with each other, providing communication between the interior and exterior of the case 51.

In the closed position, on the other hand, the shutter 58 is positioned farther rearward than in the open position. When the shutter 58 is in the closed position, the rear edge of the shutter 58 is positioned slightly rearward than the rear edges of the seal openings 56 formed in the toner seals 55. Accordingly, the shutter 58 covers the through-holes 53 formed in the case 51 and the seal openings 56 formed in the toner seals 55 in their entirety, blocking communication between the interior and exterior of the case 51.

1-5. Drive Transmission Mechanism

A drive transmission mechanism is provided in the drawer frame 31 for each of the shutter drive members 47. The drive transmission mechanism transfers a drive force to the corresponding shutter drive member 47.

Although not shown in the drawings, four operating levers are provided on the outer side of the left plate constituting the drawer frame 31. Each operating lever is fixed to a pivoting shaft that extends in the left-to-right direction, penetrating the left plate of the drawer frame 31. The pivoting shafts are rotatably supported in the left plate.

As shown in FIGS. 2 and 3, each drive transmission mechanism includes a first gear 61 fixed to the pivoting shaft of the corresponding operating lever on the inside of the drawer frame 31; a second gear 62 engaged with the first gear 61; a pinion gear 63 engaged with the second gear 62 and the left rack gear 48 of the shutter drive member 47; a pinion gear 64 engaged with the right rack gear 48 of the shutter drive member 47; and a coupling shaft 65 connecting the pinion gears 63 and 64.

When an operating lever is pivoted, that is, the operating lever moves in a circumferential direction of the arcing surface 52, causing the first gear 61 to rotate, the first gear 61 applies a rotating force to the second gear 62. The second gear 62 transfers this rotating force to the pinion gear 63, causing both pinion gears 63 and 64 to rotate. The rotating force of the pinion gears 63 and 64 is inputted into the corresponding rack gears 48, moving the shutter drive member 47 along the partitioning wall 42 in a front or rear direction and shifting the shutter drive member 47 and the shutter 58 coupled to the shutter drive member 47 between the open position and the closed position.

1-6. Opening and Closing the Shutter

When a toner cartridge 11 is separated from the drawer unit 3, the shutter 58 is in the closed position. When the toner cartridge 11 is mounted in the corresponding space 12 formed in the drawer unit 3, each of the shutter drive protrusions 49 formed on the shutter drive member 47 is engaged in the corresponding shutter drive openings 59 formed in the shutter 58 through the guide slits 73, thereby coupling the shutter 58 and the shutter drive member 47.

After the toner cartridge 11 is mounted in the space 12, the corresponding operating lever (not shown) is pivoted to move the shutter 58 from the closed position to the open position. By pivoting the operating lever, the first gear 61 rotates clockwise in a left side view. The rotation of the first gear 61 is transmitted to the rack gears 48 of the shutter drive member 47, causing the shutter drive member 47 to move forward from a position opposing the through-holes 53 formed in the partitioning wall 42 to a position not opposing the through-holes 53. As the shutter drive member 47 moves, the shutter 58 moves integrally with the shutter drive member 47 forward from the closed position to the open position.

On the other hand, in order to move the shutter 58 from the open position to the closed position, the operator pivots the operating lever (not shown) in the direction opposite the direction pivoted when moving the shutter 58 from the closed position to the open position. Pivoting the operating lever in this direction rotates the first gear 61 counterclockwise in a left side view. The rotation of the first gear 61 is transmitted to the rack gears 48, moving the shutter drive member 47 rearward. As the shutter drive member 47 moves rearward, the shutter 58 integrated with the shutter drive member 47 moves rearward from the open position to the closed position.

(1) Moving the Shutter from the Open Position to the Closed Position

Figure 6:
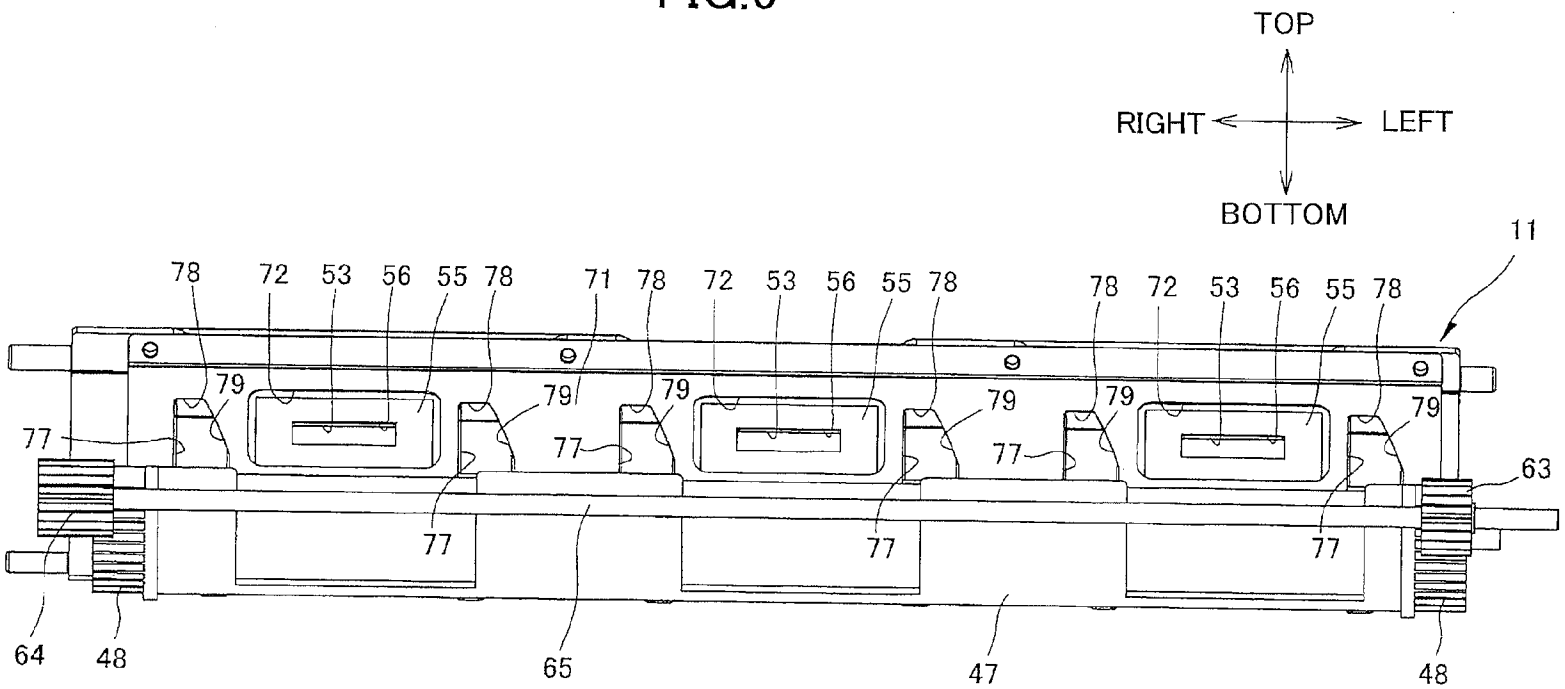
FIG. 6 is a bottom view of the toner cartridge and a shutter drive member.

When the shutter 58 is in the open position shown in FIG. 4, the shutter drive openings 59 are disposed between the first right edges 75 and the second left edges 80 of the corresponding guide slits 73. Further, as shown in FIGS. 5 and 6, the shutter drive member 47 and the shutter 58 are in the leftmost position.

Figure 7A:
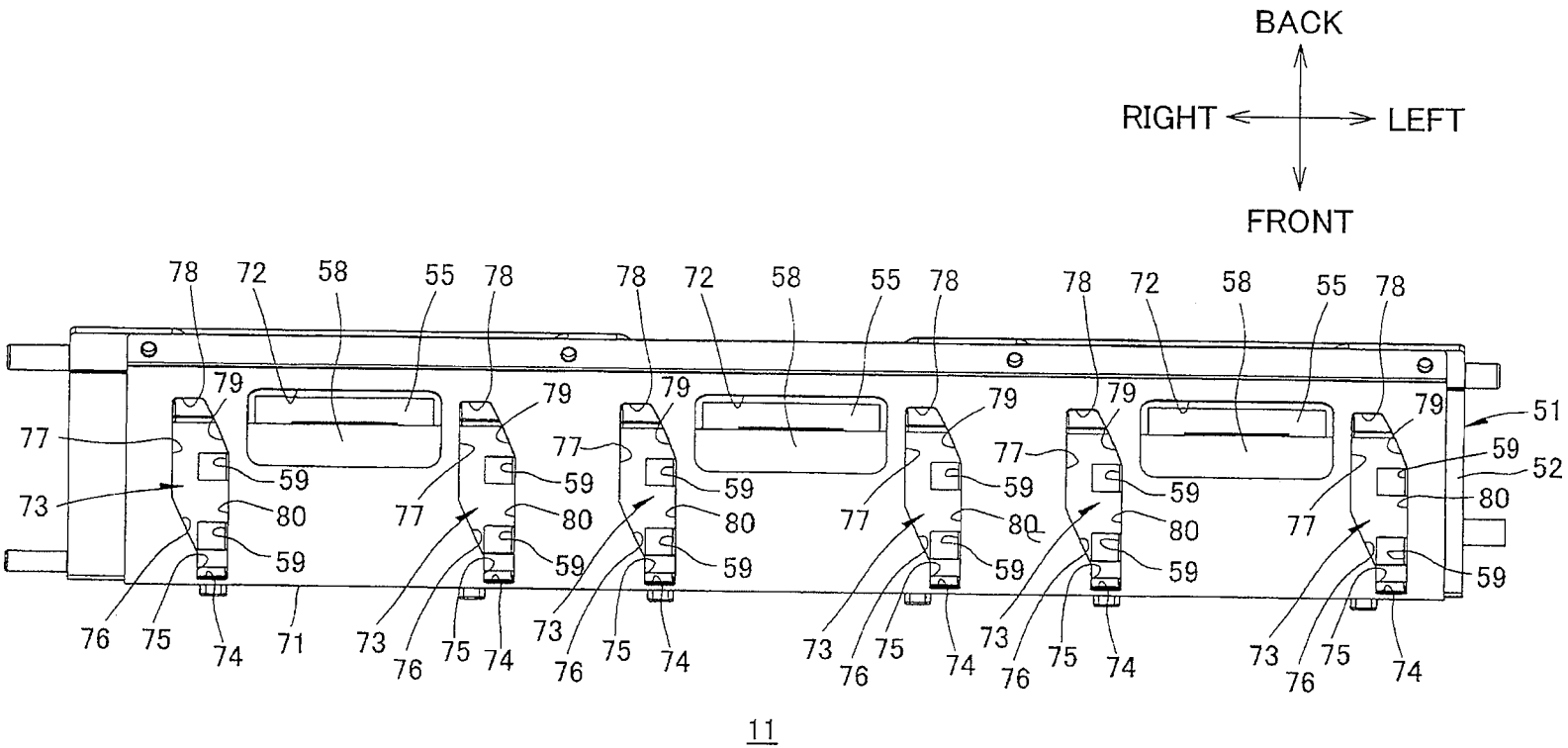
FIG. 7A is a bottom view illustrating the toner cartridge when the shutter is at a position between the closed position and the open position.
Figure 7B:
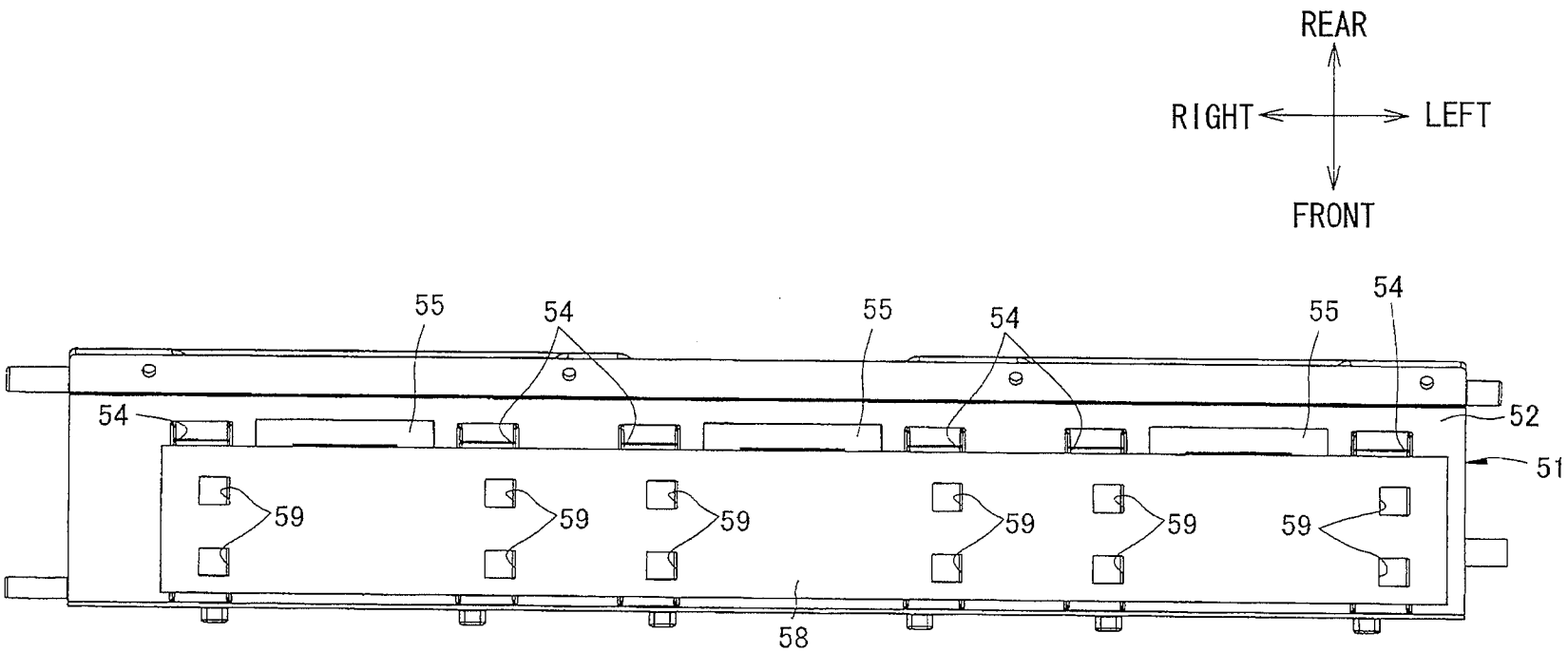
FIG. 7B is a bottom view illustrating the toner cartridge shown in FIG. 7A when the shutter cover is removed.
Figure 7C:
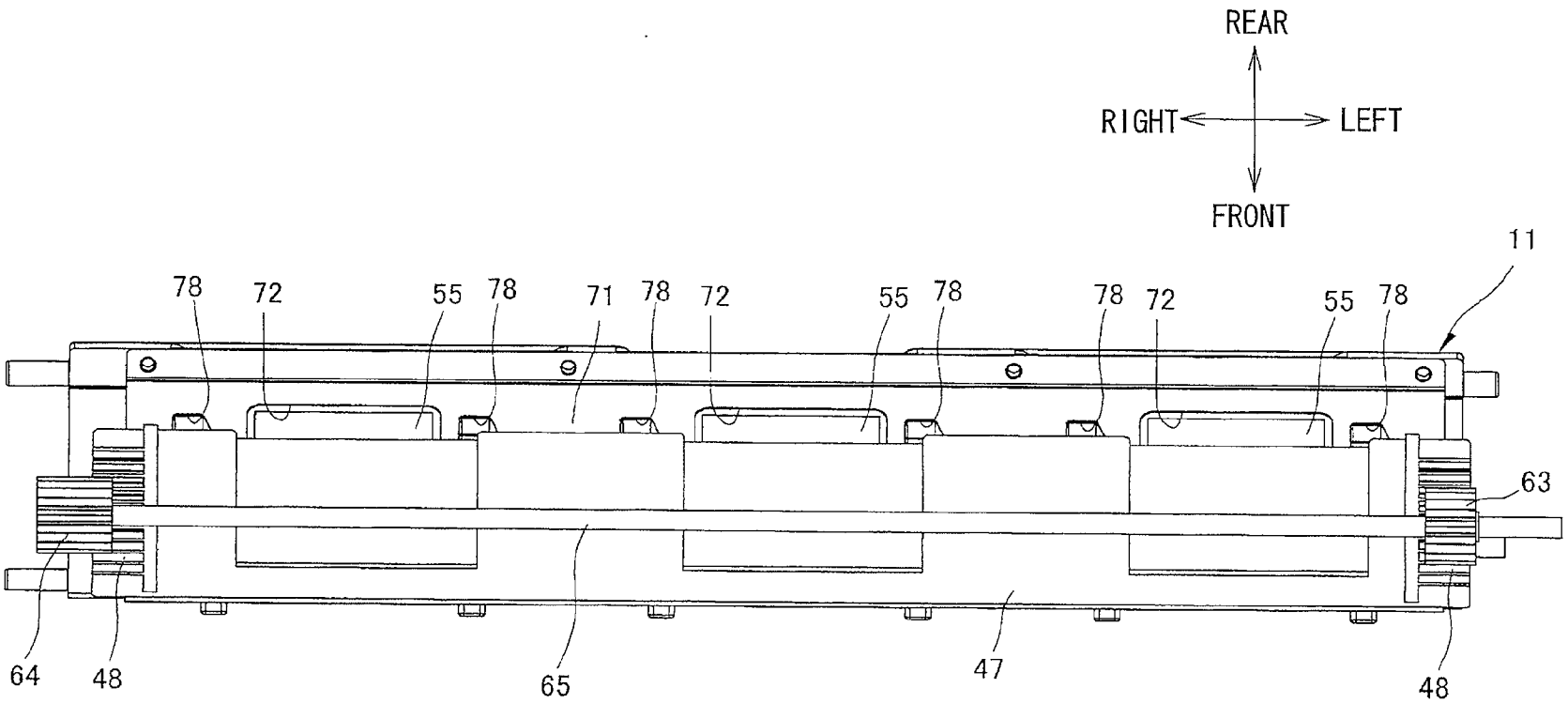
FIG. 7C is a bottom view of the toner cartridge shown in FIG. 7A and the shutter driving member.

When the pinion gears 63 and 64 input a drive force into the rack gears 48 of the shutter drive member 47, as illustrated in FIG. 7A the shutter drive protrusions 49 engaged in the shutter drive openings 59 move along the respective second left edges 80 of the guide slits 73. Accordingly, as illustrated in FIGS. 7B and 7C, the shutter drive member 47 and the shutter 58 move in a rearward direction following the second left edge 80.

Figure 8A:
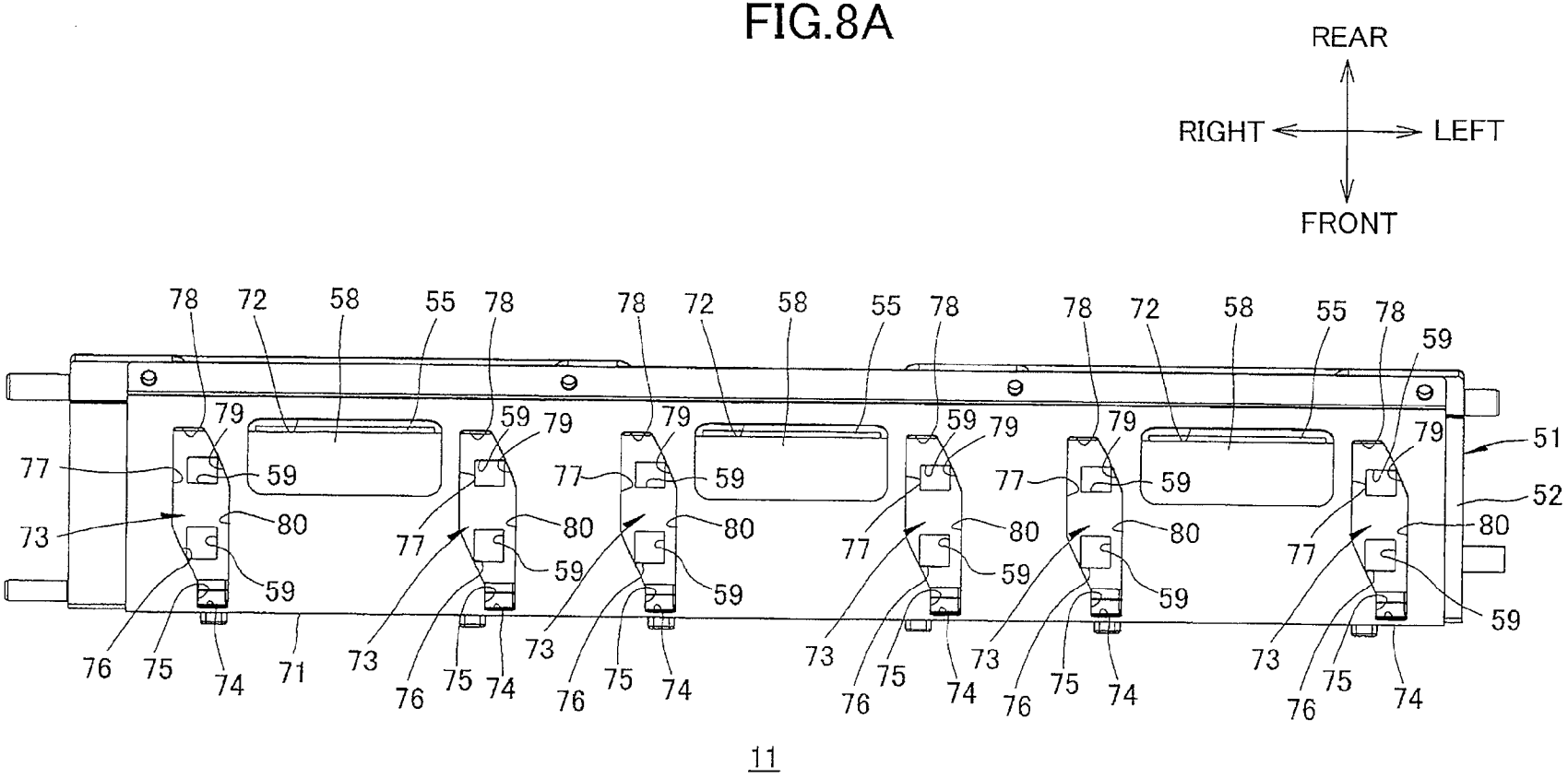
FIG. 8A is a bottom view illustrating the toner cartridge when the shutter moves toward the closed position from the position shown in FIG. 7A.
Figure 8B:
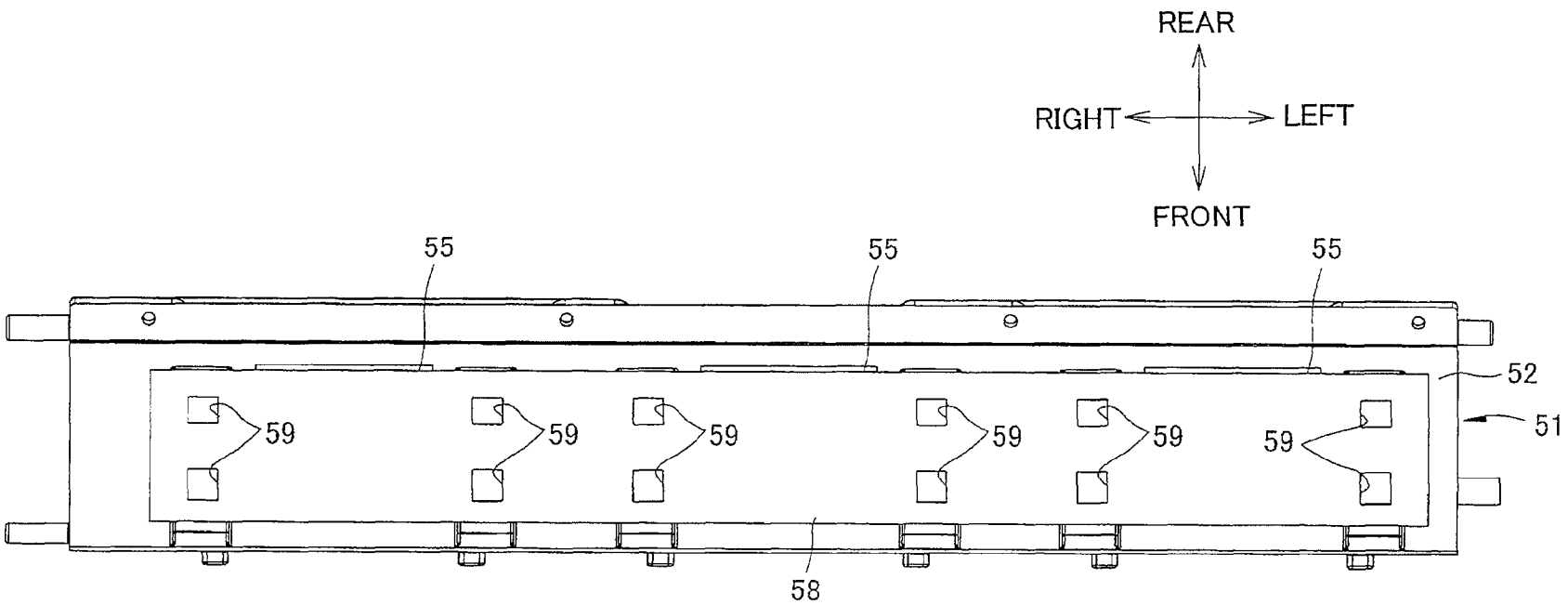
FIG. 8B is a bottom view illustrating the toner cartridge shown in FIG. 8A when the shutter cover is removed.

As the shutter drive member 47 and the shutter 58 advance in the rearward direction, the shutter drive protrusions 49 engaged in the shutter drive openings 59 on the rear side contact the first left edges 79 in the corresponding guide slits 73. Thereafter, the shutter drive protrusions 49 engaged in the shutter drive openings 59 move in a slanted direction along the corresponding first left edges 79. Accordingly, the shutter drive member 47 and the shutter 58 move in a direction following the first left edges 79, i.e., a direction slanting rightward and rearward, as shown in FIG. 8B.

Figure 9A:
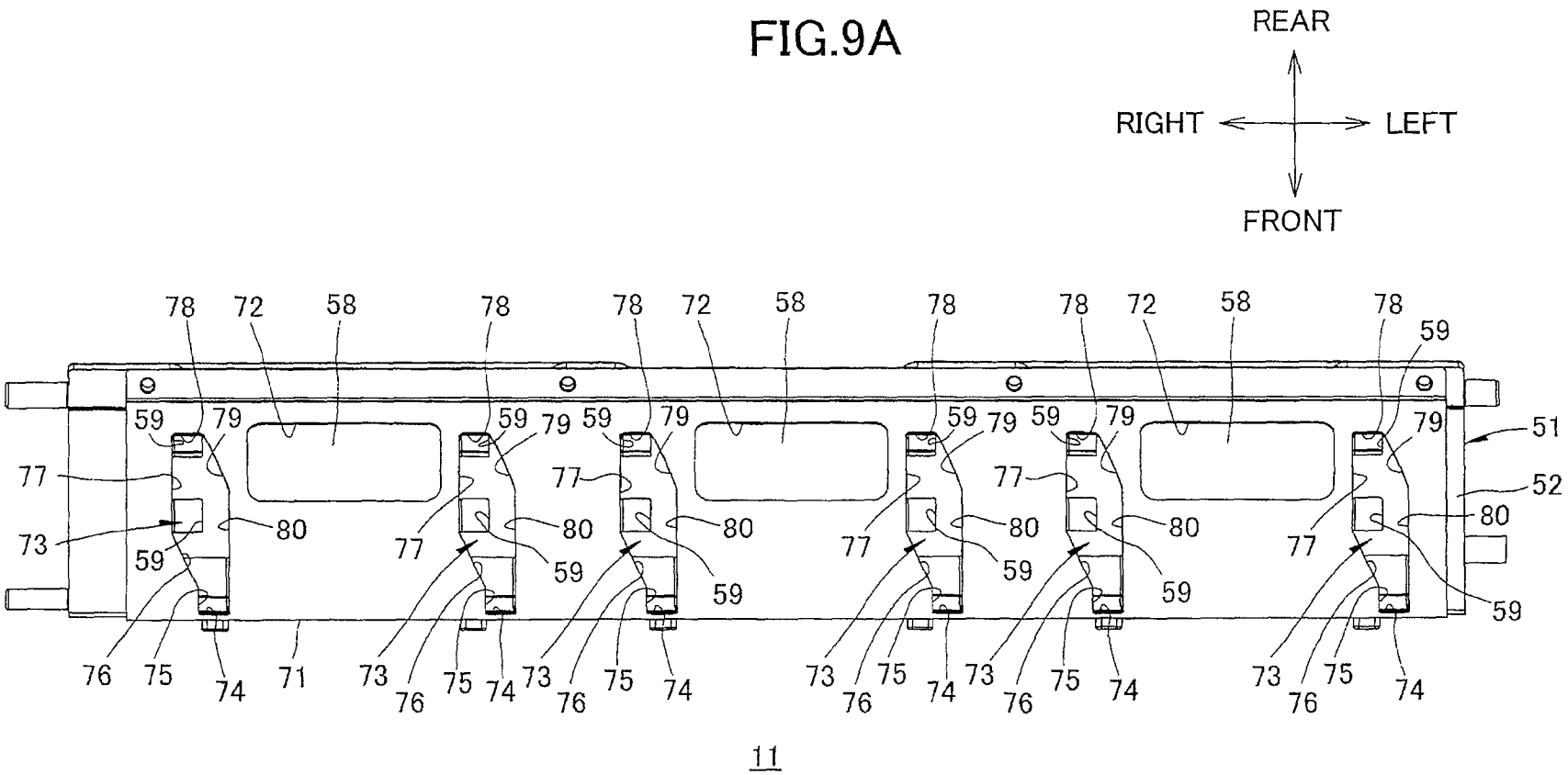
FIG. 9A is a bottom view of the toner cartridge at the closed position.
Figure 9B:
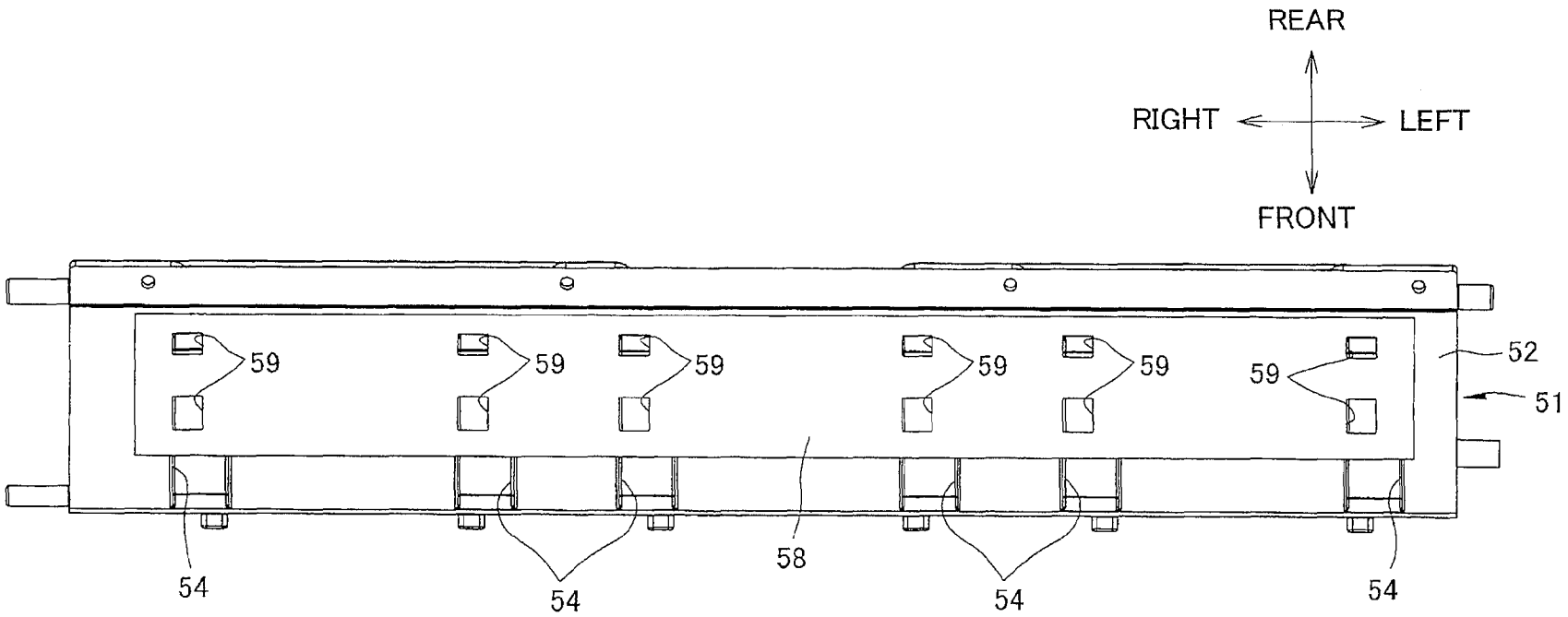
FIG. 9B is a bottom view illustrating the toner cartridge shown in FIG. 9A when the shutter cover is removed.
Figure 9C:
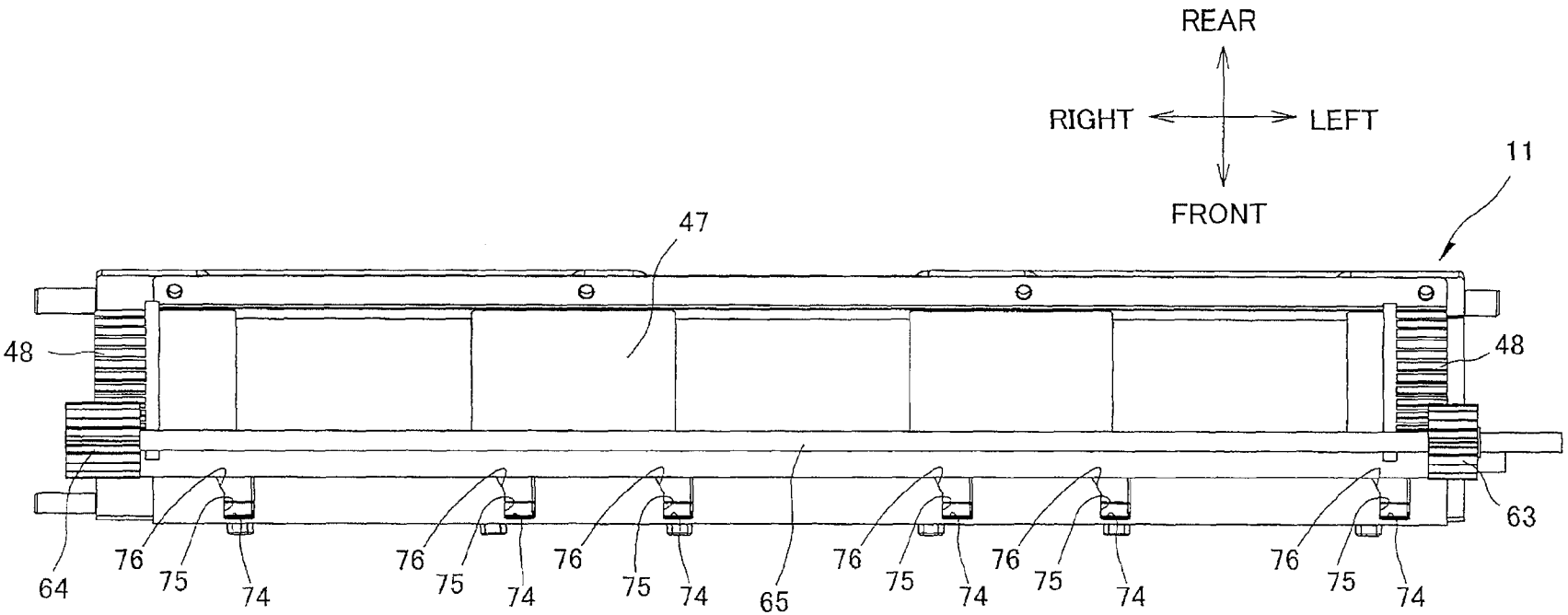
FIG. 9C is a bottom view of the toner cartridge shown in FIG. 9A and the shutter driving member.

As the shutter drive member 47 and the shutter 58 continue to advance in this direction, the shutter drive protrusions 49 engaged with the shutter drive openings 59 on the rear side contact the rear edges 78 of the corresponding guide slits 73, whereby the rear edges 78 restrict further movement of the shutter drive member 47 and the shutter 58. At this moment, the shutter drive member 47 and the shutter 58 are in the rightmost position shown in FIGS. 9A, 9B, and 9C.

(2) Moving the Shutter from the Closed Position to the Open Position

When the pinion gears 63 and 64 input a drive force into the rack gears 48, the shutter drive protrusions 49 engaged in the shutter drive openings 59 on the front side move along the second right edges 76 of the corresponding guide slits 73. Accordingly, the shutter drive member 47 and the shutter 58 move in a direction from the rightmost position along the slope of the second right edges 76, i.e., in a direction slanting leftward and forward.

As the shutter drive member 47 and the shutter 58 continue to advance in this direction, the shutter drive protrusions 49 engaged in the shutter drive openings 59 on the front side contact the second left edges 80 of the corresponding guide slits 73. Thereafter, the shutter drive protrusions 49 engaged in the shutter drive openings 59 move forward along the corresponding second left edges 80. When the shutter drive openings 59 on the front side arrive at positions between the right edges 75 and the second left edges 80 of the corresponding guide slits 73, the shutter drive member 47 and the shutter 58 have completed their return to the leftmost position shown in FIGS. 4, 5, and 6.

1-7. Operations and Effects

As described above, the shutter 58 is provided for opening and closing the through-hole 53. That is, the shutter 58 is movable between the open position in which the shutter 58 opens the through-hole 53 and the closed position in which the shutter 58 closes the through-hole 53. When the shutter 58 is in the closed position, the toner seals 55 having the seal openings 56 corresponding to the through-holes 53 are interposed between the case 51 and the shutter 58. Further, the shutter cover 71 is disposed on the opposite side of the case 51 from the shutter 58. Hence, the shutter 58 is interposed between the case 51 and the shutter cover 71.

The shutter cover 71 is formed with the guide slits 73. The developing unit 7 includes the shutter drive member 47 that has the shutter drive protrusions 49. The shutter drive protrusions 49 are inserted through the guide slits 73 and engaged in the shutter drive openings 59 formed in the shutter 58. With the shutter drive protrusions 49 engaged in the shutter drive openings 59 in this way, the shutter 58 moves together with the shutter drive member 47.

The guide slits 73 have respective second right edges 76 and first left edges 79 extending in an oblique direction to the direction of the drive force inputted from the shutter drive protrusions 49 into the shutter drive openings 59. Accordingly, when the shutter 58 moves together with the shutter drive member 47, the shutter drive protrusions 49 move along the respective second right edges 76 or first left edges 79, causing the shutter 58 to move in a slanted direction. Since the edge of the shutter 58 positioned on the downstream side with respect to the moving direction moves at a slant to the toner seals 55 (in other words, the shutter 58 moves in a direction that is inclined from a circumferential direction of the arcing surface 52), the edge of the shutter 58 is prevented from catching on the toner seals 55. Hence, this configuration ensures the smooth operation of the shutter 58.

The guide slits 73 also have respective first right edges 75 and second left edges 80 extending along the direction of force applied to the shutter 58. Hence, when the shutter 58 moves together with the shutter drive member 47, the shutter 58 can also be moved in the direction of the drive force inputted from the shutter drive protrusions 49 into the shutter drive openings 59, and not just along a slanted direction.

[Variations of the First Embodiment]

Figure 10:
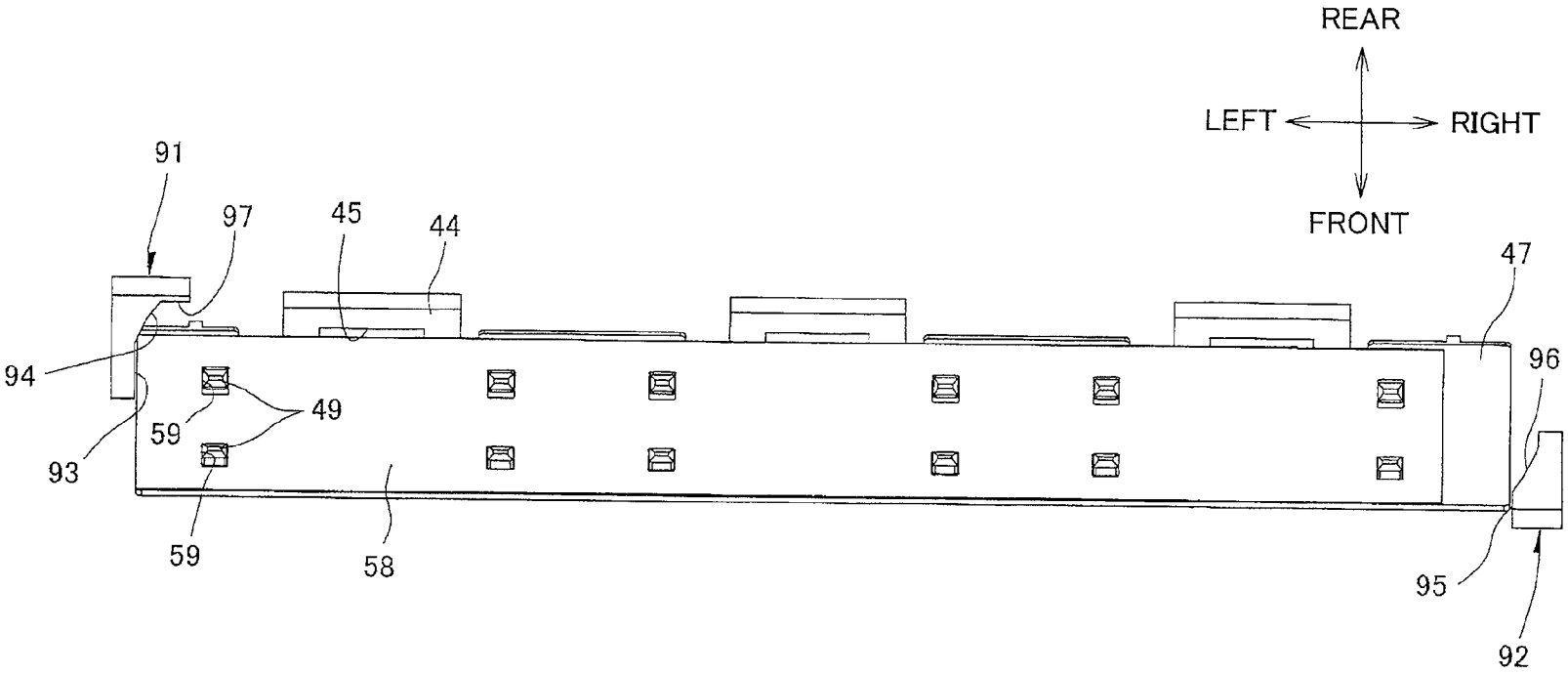
FIG. 10 is a plain view of a developing unit and a toner cartridge according to a variation of the first embodiment.

In the first embodiment described above, movement of the shutter drive member 47 and the shutter 58 is controlled by guiding the shutter drive protrusions 49 in the guide slits 73. However, as an alternative to this construction illustrated in FIG. 10, guide members 91 and 92 may be provided in the developing unit 7 (on the partitioning wall 42 of the developing unit frame 8) for guiding movement of the shutter drive member 47 directly.

(1) Structure of the Guide Members

The guide members 91 is disposed on the left and rear side of the shutter drive member 47 and the guide member 92 is disposed on the right and front side of the shutter drive member 47.

The guide member 91 is disposed the left and rear side of the shutter 58. The guide member 91 has a parallel surface 93 extending in the front-to-rear direction on the right side of the guide member 91, a sloped surface 94 extending from the rear edge of the parallel surface 93 along a slope rearward and rightward, and a restricting surface 97 extending rightward from the rear edge of the sloped surface 94.

The guide member 92 has a parallel surface 95 extending in the front-to-rear direction on the left side thereof, and a sloped surface 96 extending from the rear edge of the parallel surface 95 along a slope rightward and rearward.

(2) Moving the Shutter from the Open Position to the Closed Position

Figure 11:
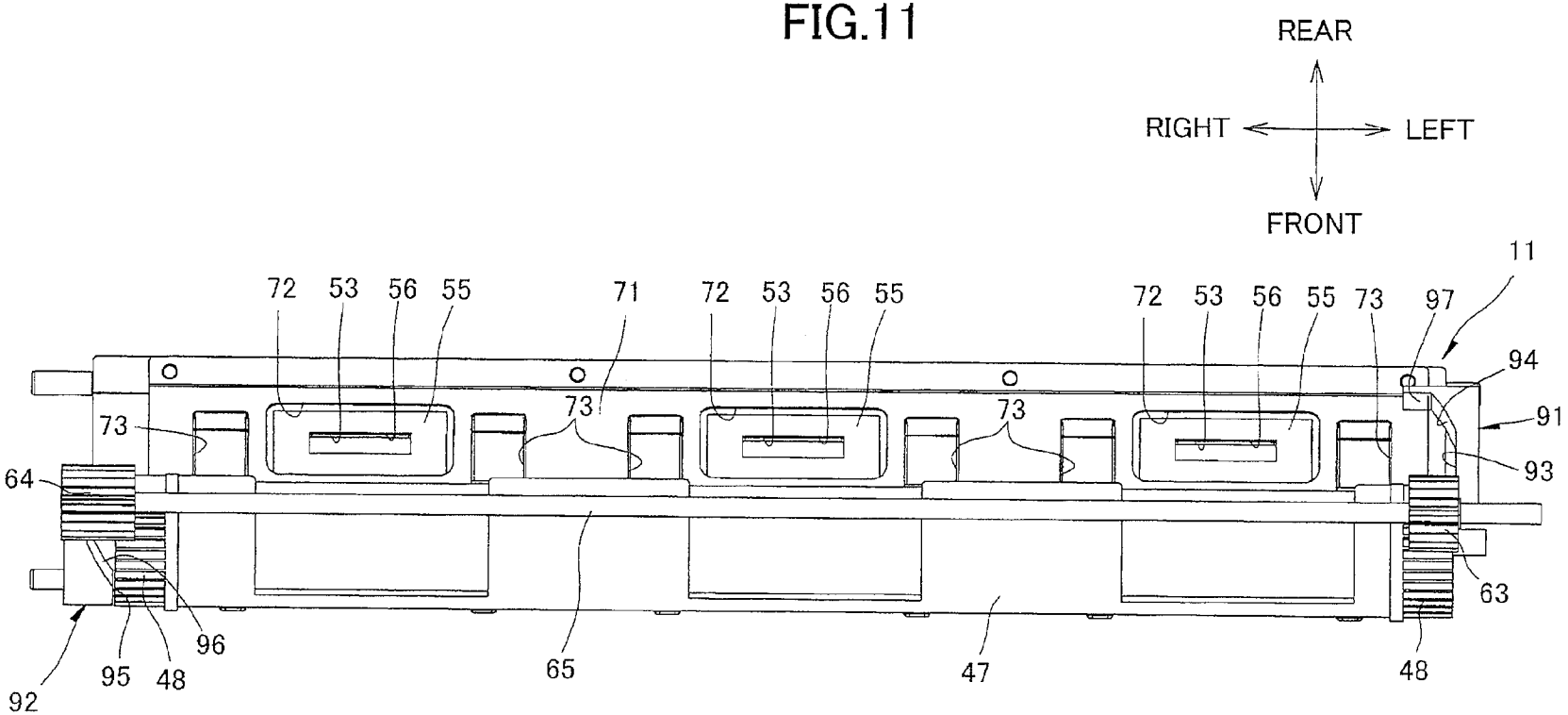
FIG. 11 is a bottom view illustrating the toner cartridge shown in FIG. 10 and a drive member when a shutter is in an open position.

When the shutter 58 (FIG. 2) is in the open position, as shown in FIG. 11, the left edge of the shutter drive member 47 is in contact with the parallel surface 93 of the guide member 91, and the shutter drive member 47 and the shutter 58 are in the leftmost position.

When the pinion gears 63 and 64 input a drive force into the rack gears 48 of the shutter drive member 47 at this time, the shutter drive member 47 and the shutter 58 move in a direction along the parallel surface 93 of the guide member 91 while the left edge of the shutter drive member 47 slides along the parallel surface 93.

Figure 12:
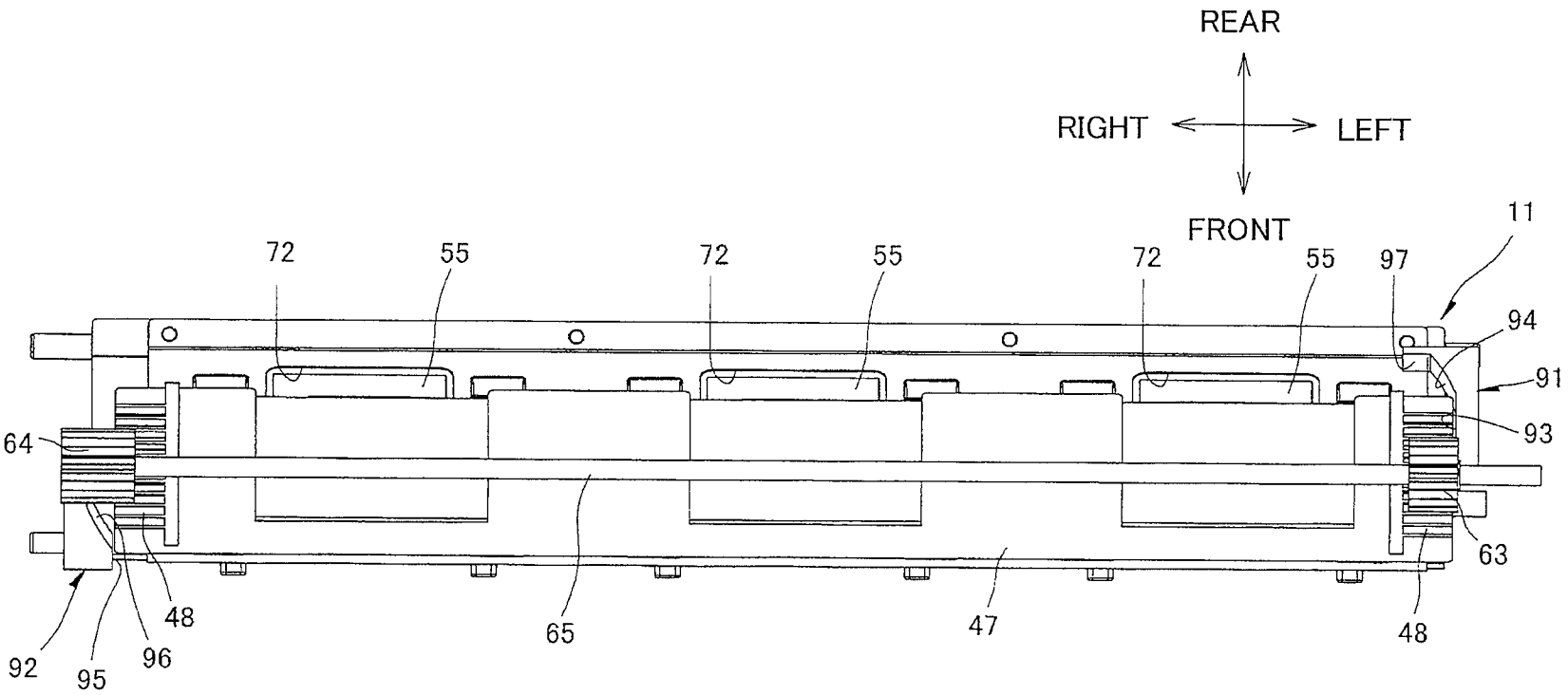
FIG. 12 is a bottom view illustrating the toner cartridge shown in FIG. 10 and a drive member when the shutter is at a position between the open position and a closed position.

As the shutter drive member 47 and the shutter 58 advance in this direction, as shown in FIG. 12 the rear left corner of the shutter drive member 47 contacts the sloped surface 94 of the guide member 91. Thereafter, the shutter drive member 47 and the shutter 58 move in a direction parallel to the sloped surface 94 of the guide member 91, i.e., along a rightward and rearward slant, while the rear left corner of the shutter drive member 47 slides along the sloped surface 94.

Figure 13:
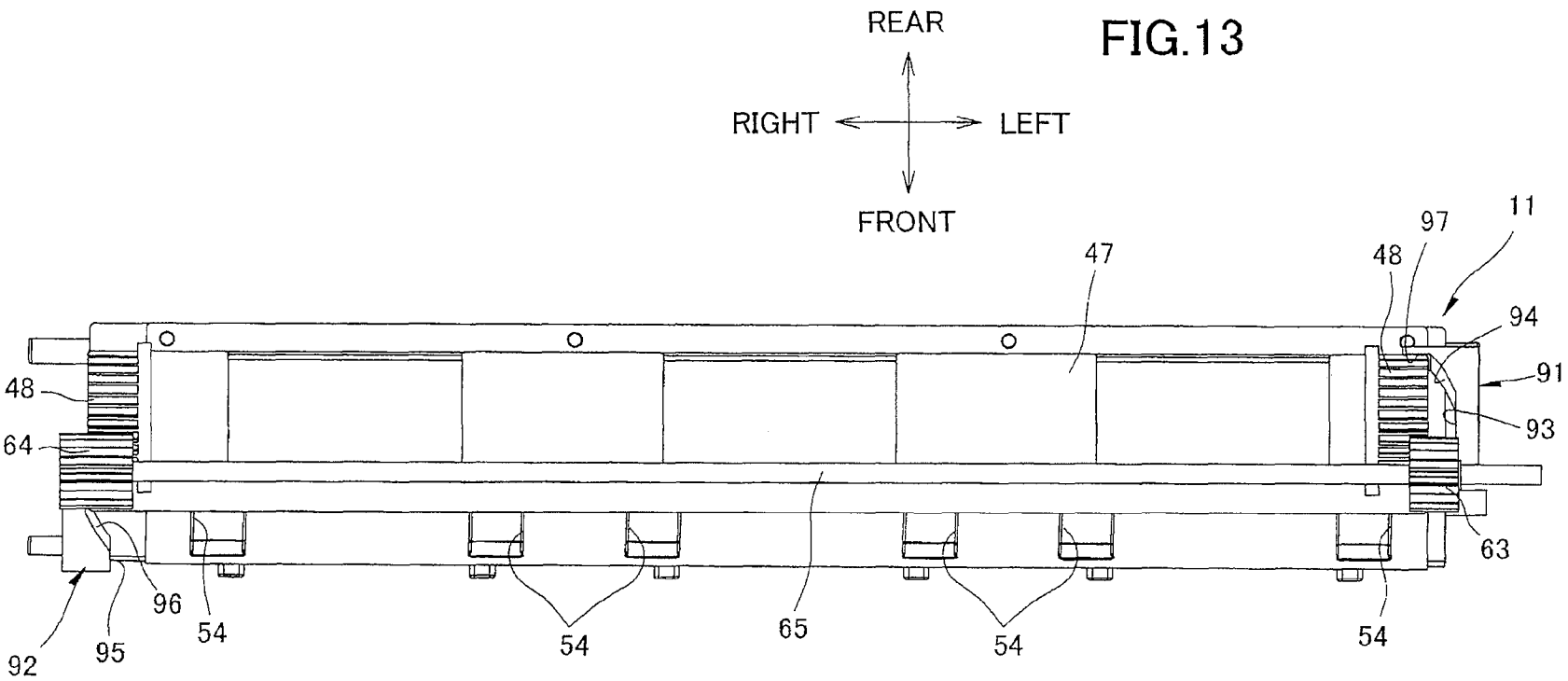
FIG. 13 is a bottom view illustrating the toner cartridge shown in FIG. 10 and a drive member when the shutter is in the closed position.

As the shutter drive member 47 and the shutter 58 advance in this direction, the rear edge of the shutter drive member 47 contacts the restricting surface 97 of the guide member 91, as shown in FIG. 13, and the restricting surface 97 restricts further movement of the shutter drive member 47 and the shutter 58. At this time, the shutter drive member 47 and the shutter 58 are in the rightmost position shown in FIG. 9B and 9C. Further, the front right corner of the shutter drive member 47 is in contact with the sloped surface 96 of the guide member 92.

(3) Moving the Shutter from the Closed Position to the Open Position

When the pinion gears 63 and 64 input a drive force into the rack gears 48 of the shutter drive member 47, the shutter drive member 47 and the shutter 58 move in a direction parallel to the sloped surface 96 of the guide member 92, i.e., along a forward and leftward slope, while the right front corner of the shutter drive member 47 slides along the sloped surface 96.

As the shutter drive member 47 and the shutter 58 advance in this direction, the left edge of the shutter drive member 47 contacts the parallel surface 93 of the guide member 91. Thereafter, the shutter drive member 47 and the shutter 58 move in a direction parallel to the parallel surface 93, while the left edge of the shutter drive member 47 slides along the parallel surface 93, and return to the state shown in FIG. 11.

The structure of the guide parts according to the variation of the first embodiment can achieve the same operations and effects as the structure described in the first embodiment.

[Second Embodiment]

The following description of a second embodiment will focus on points of difference from the first embodiment, wherein like parts and components are designated with the same reference numerals to avoid duplicating description.

2-1. Drawer Frame

Figure 14:
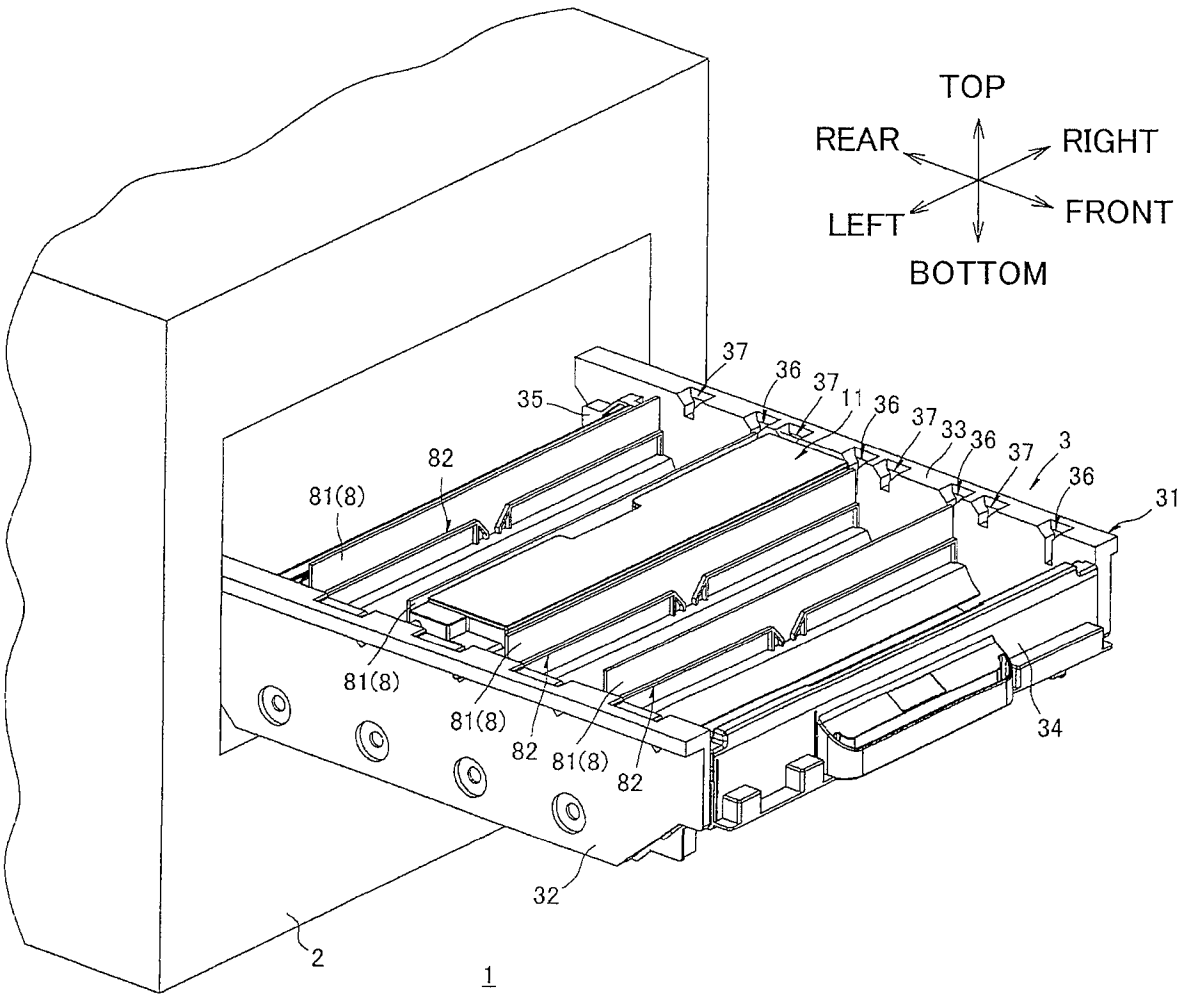
FIG. 14 is a perspective view illustrating a color printer according to a second embodiment when a drawer unit is positioned at a withdrawn position.

FIG. 14 is a perspective view of the color printer 1 when the drawer frame 31 is in a withdrawn position according to the second embodiment. In FIG. 14, the front cover is abbreviated.

Note that only one of the toner cartridges 11 is shown mounted in the drawer frame 31 in FIG. 14, while the other three toner cartridges 11 have been omitted from the drawing.

The drawer frame 31 according to the second embodiment is configured of a pair of side plates 32 and 33 arranged parallel to each other and separated in the left-to-right direction, a front beam 34 bridging the front ends of the side plates 32 and 33, and a rear beam 35 bridging the rear ends of the side plates 32 and 33. The overall structure of the drawer frame 31 is square-shaped in a plan view.

The respective groups of the four photosensitive drums 5, the chargers 6, and the developing units 7 (see FIG. 1) are all held between the side plates 32 and 33 of the drawer frame 31 on the left and right sides thereof. The spaces 12 in which the toner cartridges 11 are mounted are formed between the side plates 32 and 33 above the corresponding developing units 7. In other words, the side plates 32 and 33 oppose each other in the left-to-right direction for retaining the photosensitive drums 5, the chargers 6, and the developing units 7 while defining the left and right sides of gaps allocating the spaces 12 in which the toner cartridges 11 are mounted.

A pair of support grooves 36 and 37 spaced apart in the front-to-rear direction is formed in the inner side surface (left side surface) of the right side plate 33 for each of the spaces 12. The support grooves 36 and 37 extend vertically and are open in the top of the right side plate 33. In addition, the upper end portions of the support grooves 36 and 37 widen toward the top, forming a general Y-shape in a side view. Within each pair of the support grooves 36 and 37, the support groove 36 on the front side is formed vertically longer than the support groove 37 on the rear side.

2-2. Developing Unit

The developing units 7 are retained in the drawer frame 31 such that the developing unit frames 8 of the developing units 7 are spaced at regular intervals in the front-to-rear direction and span between the side plates 32 and 33 of the drawer frame 31. Each developing unit frame 8 defines a space 12 in the drawer frame 31 for mounting a corresponding toner cartridge 11.

Figure 16:
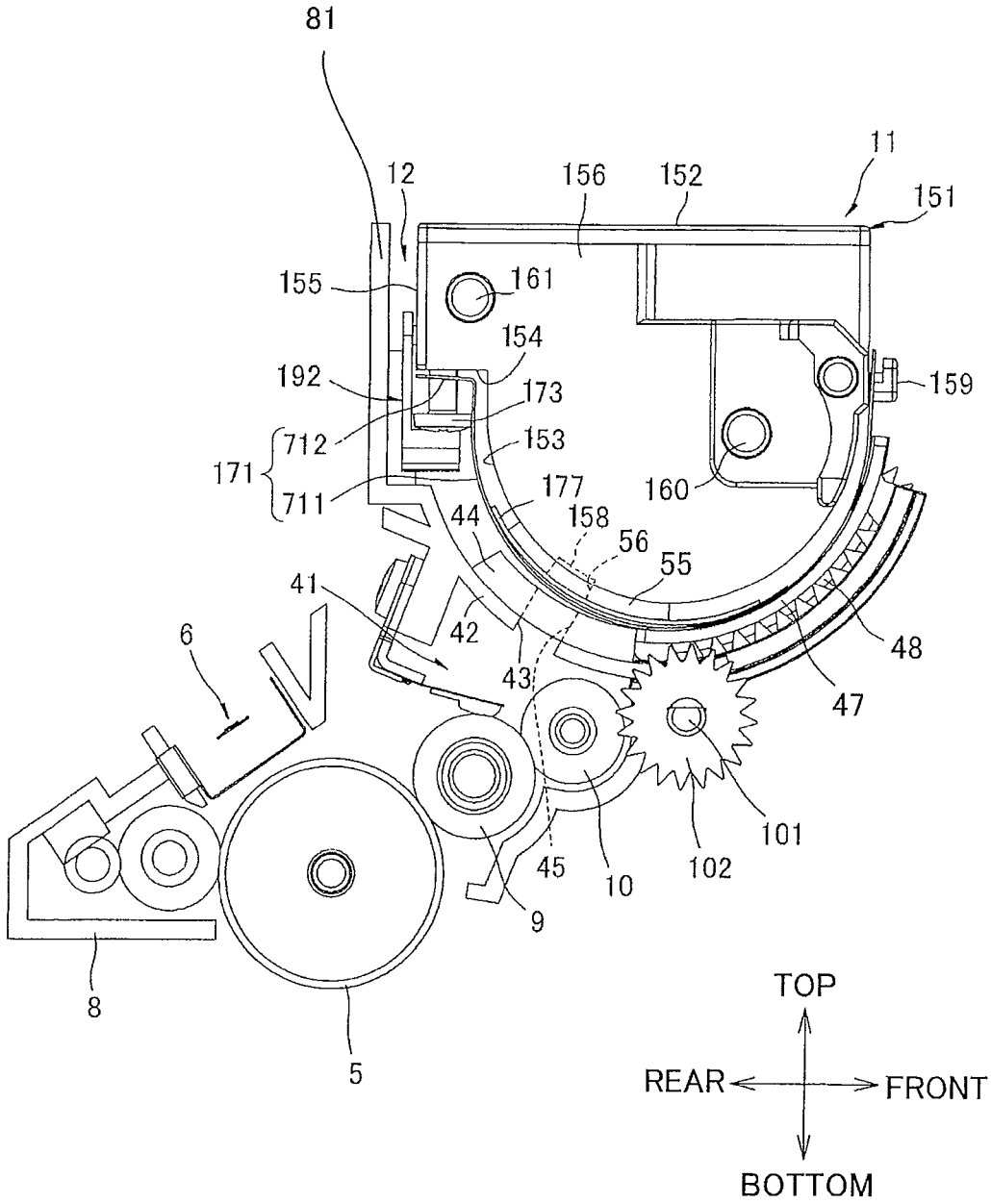
FIG. 16 is a cross section of the drawer unit.

As shown in FIG. 16, the developing unit frame 8 includes toner cartridges 11, the partitioning wall 42, the three through-holes 43, the three frame seals 44 similarly to the first embodiment. Here, the through-holes 43 are formed at positions opposing three through-holes 158 (described later) formed in the toner cartridge 11 when the toner cartridge 11 is mounted in the space 12.

Figure 15:
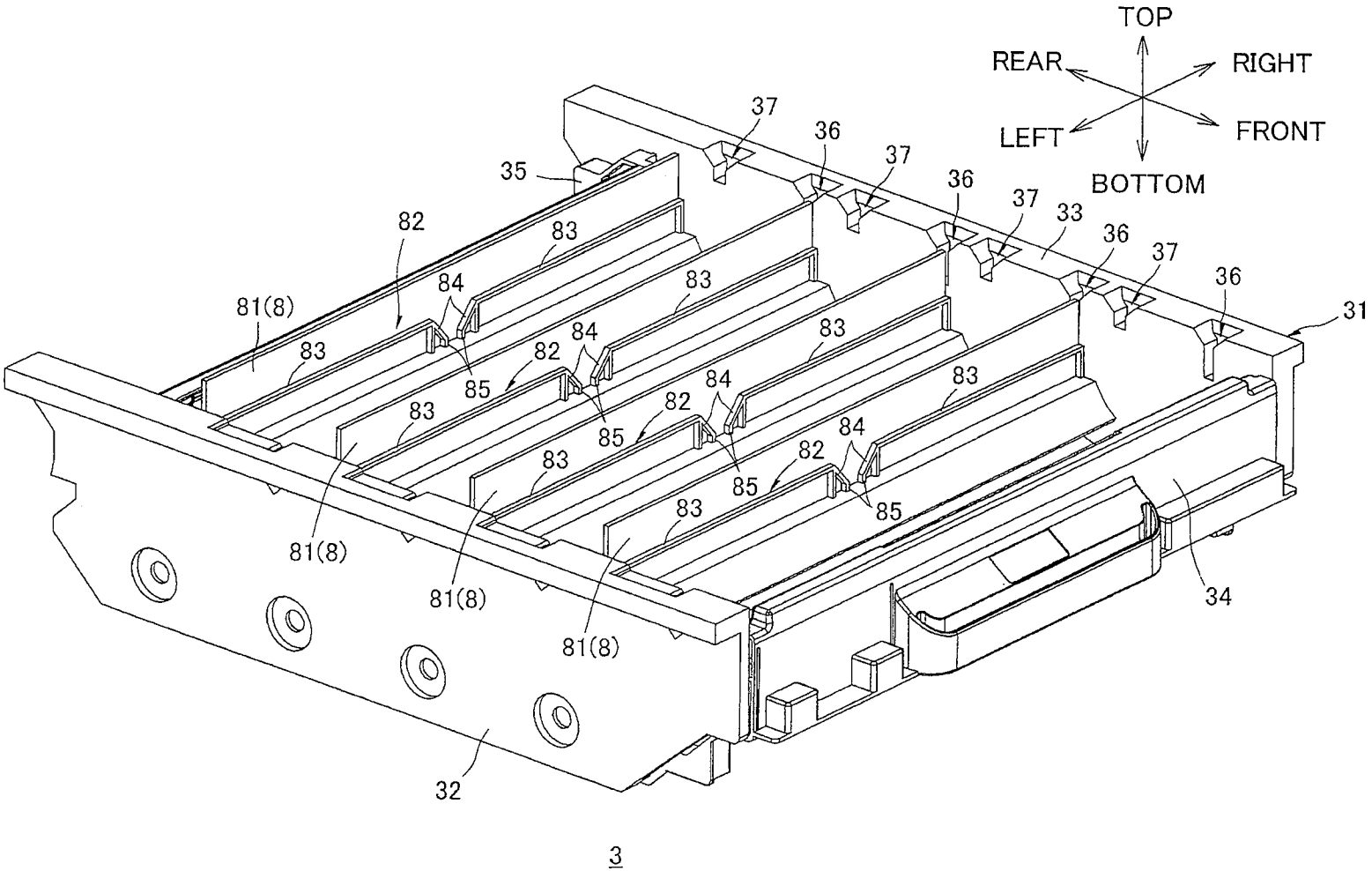
FIG. 15 is a perspective view of the drawer unit.

As shown in FIGS. 15 and 16, each developing unit frame 8 has a rear wall 81 that extends slightly rearward from the rear edge of the partitioning wall 42 (see FIG. 16), bends upward at a right angle, and extends farther upward.

As shown in FIG. 15, an operating member guide rib 82 is formed on the surface of the rear wall 81 facing the space 12 side. The operating member guide rib 82 is formed in a symmetrical shape about the left-to-right center of the rear wall 81. The operating member guide rib 82 is configured of two horizontal parts 83 extending in the left-to-right direction and positioned one on either side of the left-to-right center of the rear wall 81; sloped parts 84 extending from the respective ends of the horizontal parts 83 nearest the left-to-right center of the rear wall 81 along a downward slope relative to the horizontal so as to approach each other; and two vertical parts 85 extending downward from the bottom ends of the respective sloped parts 84.

2-3. Shutter Drive Member

In the second embodiment, shutter drive protrusions 49 are formed at positions corresponding to shutter drive openings 178 (described later).

2-4. Toner Cartridges (1) Case

Figure 17:
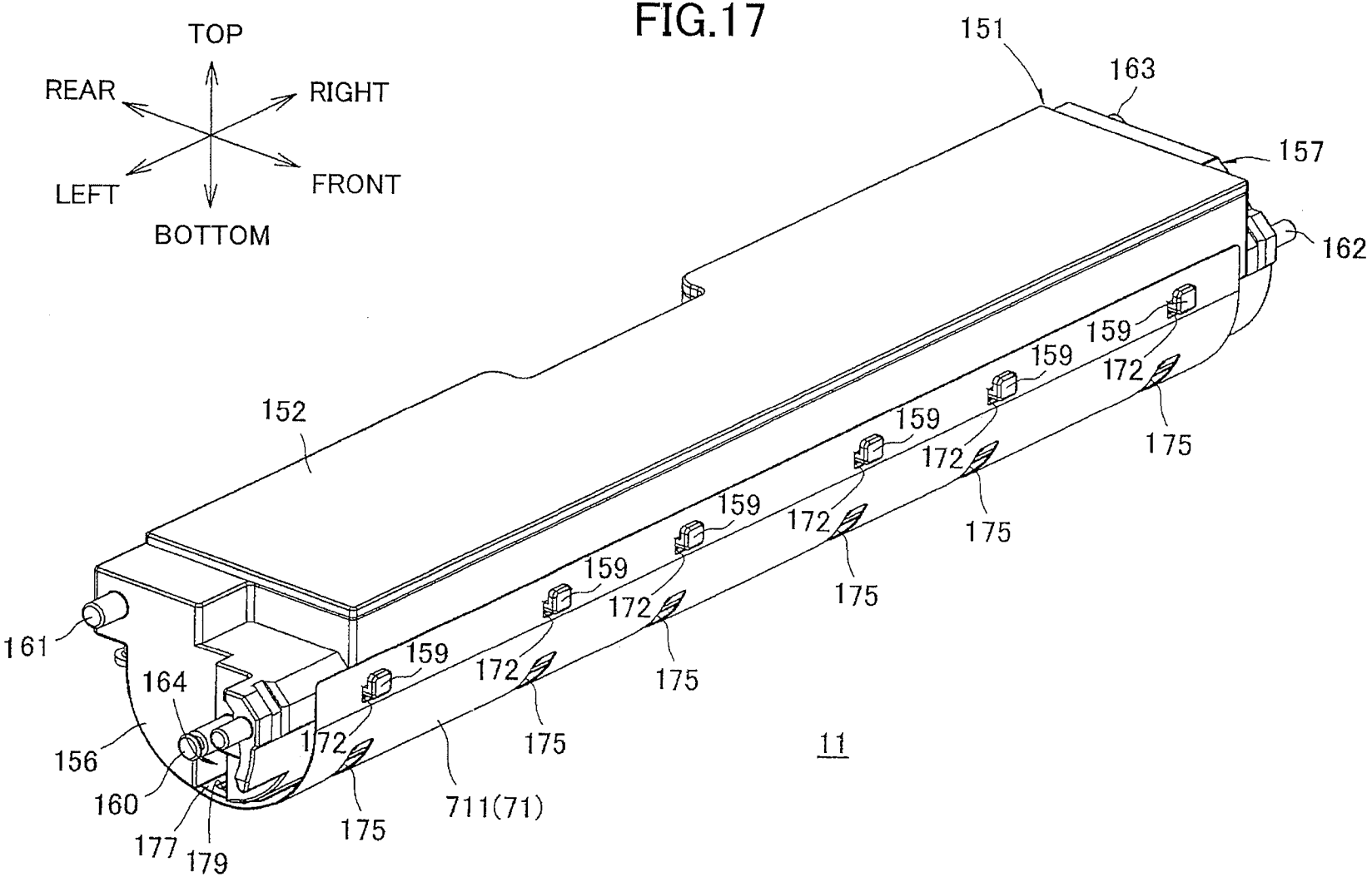
FIG. 17 is a perspective view of a toner cartridge according to the second embodiment from a left top view.

As shown in FIGS. 16 and 17, the toner cartridge 11 includes a case 151 for accommodating toner. The case 151 is formed of a resin material in a substantially hollowed-out semicircular column shape and is elongated in the left-to-right direction. The case 151 includes an arcing surface 152 having a substantially semicircular arc shape in cross section, with the convex side facing downward: The case 151 has a substantially rectangular-shaped top surface 152 elongated in the left-to-right direction; an arcing surface 153 connected to the front edge of the top surface 152 having a substantially semicircular arc shape in cross section, with the convex side facing downward; a fixing surface 154 extending rearward from the rear edge of the arcing surface 153 and parallel to the top surface 152; a rear surface 155 connecting the rear edge of the top surface 152 to the rear edge of the fixing surface 154; a left side surface 156 spanning between the respective left edges of the top surface 152, the arcing surface 153, the fixing surface 154, and the rear surface 155, and a right side surface 157 spanning between the respective right edges of the top surface 152, the arcing surface 153, the fixing surface 154, and the rear surface 155.

As indicated by the dashed line in FIG. 16, the three through-holes 158 are formed in the arcing surface 153 of the case 151 at positions slightly rearward of the lowest end thereof. The through-holes 158 are rectangular in shape and elongated in the left-to-right direction, and are spaced at intervals in the left-to-right direction. The through-holes 158 provided communication between the interior and exterior of the case 151.

As shown in FIGS. 16 and 17, a plurality of positioning protrusions 159 is formed in the front edge of the arcing surface 153. The positioning protrusions 159 are spaced at intervals in the left-to-right direction. Each positioning protrusion 159 has a hook shape that extends forward, then bends and extends upward.

As shown in FIG. 17, columnar-shaped support protrusions 160 and 161 are respectively disposed on the lower front and upper rear of the left side surface 156 and protrude outwardly therefrom. Similarly, columnar-shaped support protrusions 162 and 163 are respectively disposed on the lower front and upper rear of the right side surface 157 and protrude outwardly therefrom. A recessed part 164 is formed in the bottommost part of the arcing surface 153 on the left end of the case 151.

(2) Toner Seals

As shown in FIG. 16, similarly to the first embodiment, the three toner seals 55 are affixed to the arcing surface 153 of the case 151. One of the toner seals 55 is provided around each of the through-holes 158. In the second embodiment, the seal openings 56 are in communication with the corresponding through-holes 158.

(3) Shutter Cover

Figure 18A:
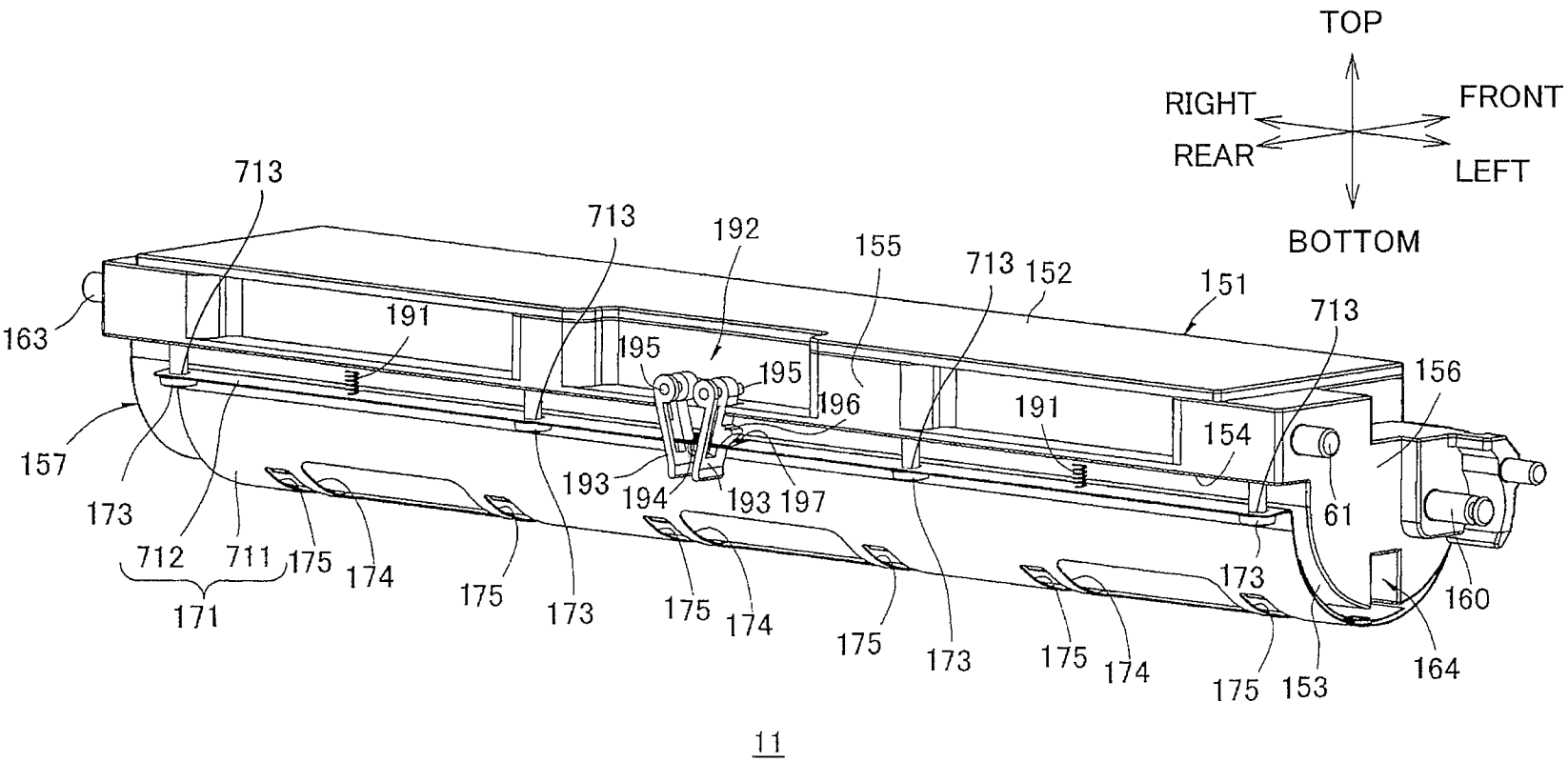
FIG. 18A is a perspective view illustrating the toner cartridge from a left rear view when a shutter cover is at a first position.
Figure 18B:
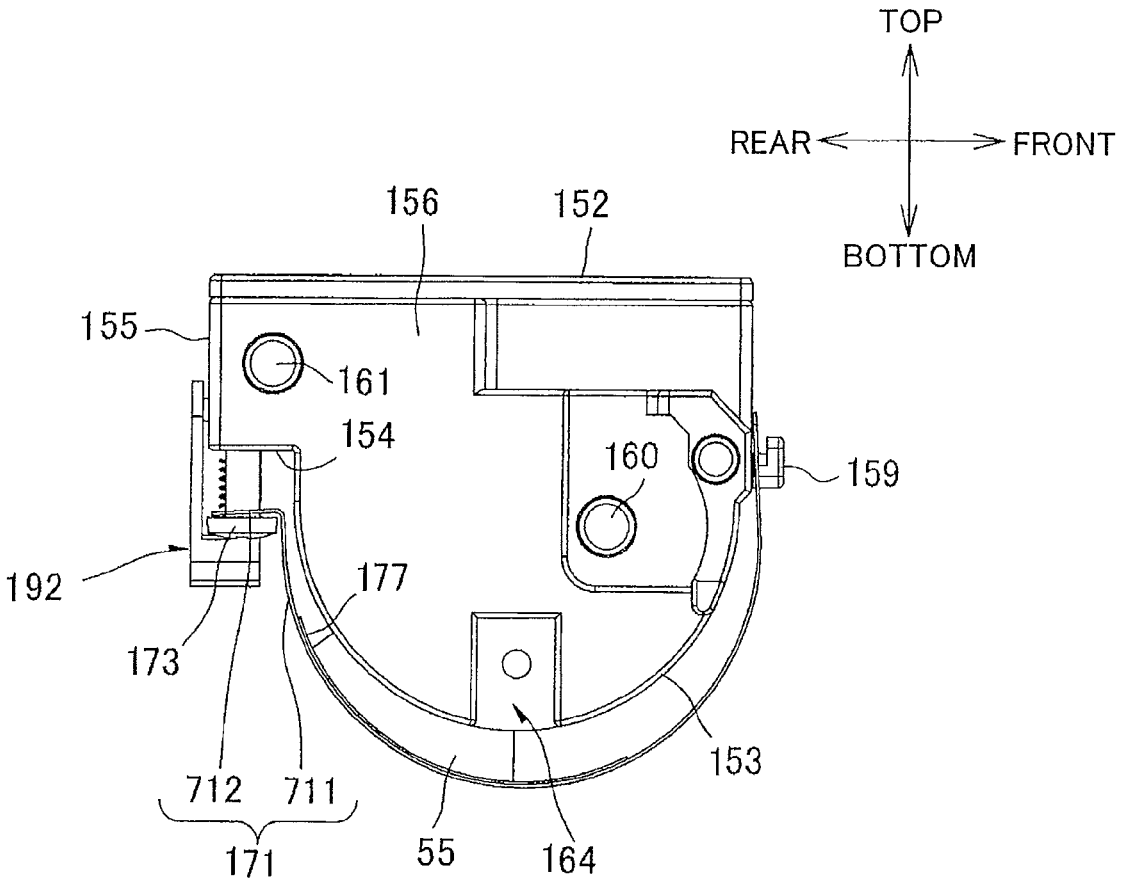
FIG. 18B is a cross section of the toner cartridge shown in FIG. 18A.

The toner cartridge 11 includes a flexible shutter cover 171 that is resiliently deformable as described later in detail. The flexible shutter cover 171 is disposed so as to cover the arcing surface 153 of the case 151. The shutter cover 171 is formed of a thin metal plate, for example. As shown in FIGS. 16-18B, the shutter cover 171 is integrally provided with a curved part 711 curved to conform to the arcing surface 153, and a flat part 712 extending from the rear edge of the shutter cover 171 substantially parallel to the fixing surface 154. As shown in FIG. 18A, the left-to-right dimension of the shutter cover 171 is approximately equal to the same dimension of the arcing surface 153, so that the shutter cover 171 covers the arcing surface 153 across substantially the entire width in the left-to-right direction.

A plurality of positioning holes 172 is formed in the front edge of the curved part 711 at intervals in the left-to-right direction. The positioning protrusions 159 formed on the arcing surface 153 are engaged in the positioning holes 172. More specifically, the positioning holes 172 are formed in the front edge of the curved part 711 at positions in the left-to-right direction corresponding to the positioning protrusions 159 and of a sufficient size for inserting the positioning protrusions 159. After the positioning protrusions 159 are inserted into the corresponding positioning holes 172, the top edges of the positioning holes 172 engage the positioning protrusions 159. In other words, the front side end of the shutter cover 171 is fixed by engaging the positioning protrusions 159 with the positioning holes.

As shown in FIG. 18A, a plurality of screws 173 is loosely inserted through insertion holes 713 formed in the flat part 712, and the ends of the screws 173 are screwed into the fixing surface 154 so that a gap remains between the heads of the screws 173 and the fixing surface 154. In this way, the shutter cover 171 is attached to the case 151, while the flat part 712 can be placed in contact with or separated from the fixing surface 154.

Cover openings 174 are formed in the curved part 711 at positions corresponding to the toner seals 55. Each of the cover openings 174 has a rectangular shape and is elongated in the left-to-right direction. The cover openings 174 have a greater open area than the area of the through-holes 158, thereby exposing the through-holes 158 in their entirety, as well as a portion of the toner seals 55 around the through-holes 158.

Guide slit 175 are also formed in the curved part 711, with one on the left and right sides of each cover opening 174. The guide slits 175 are elongated in the front-to-rear direction (circumferential direction of the shutter cover 171).

Figure 19A:
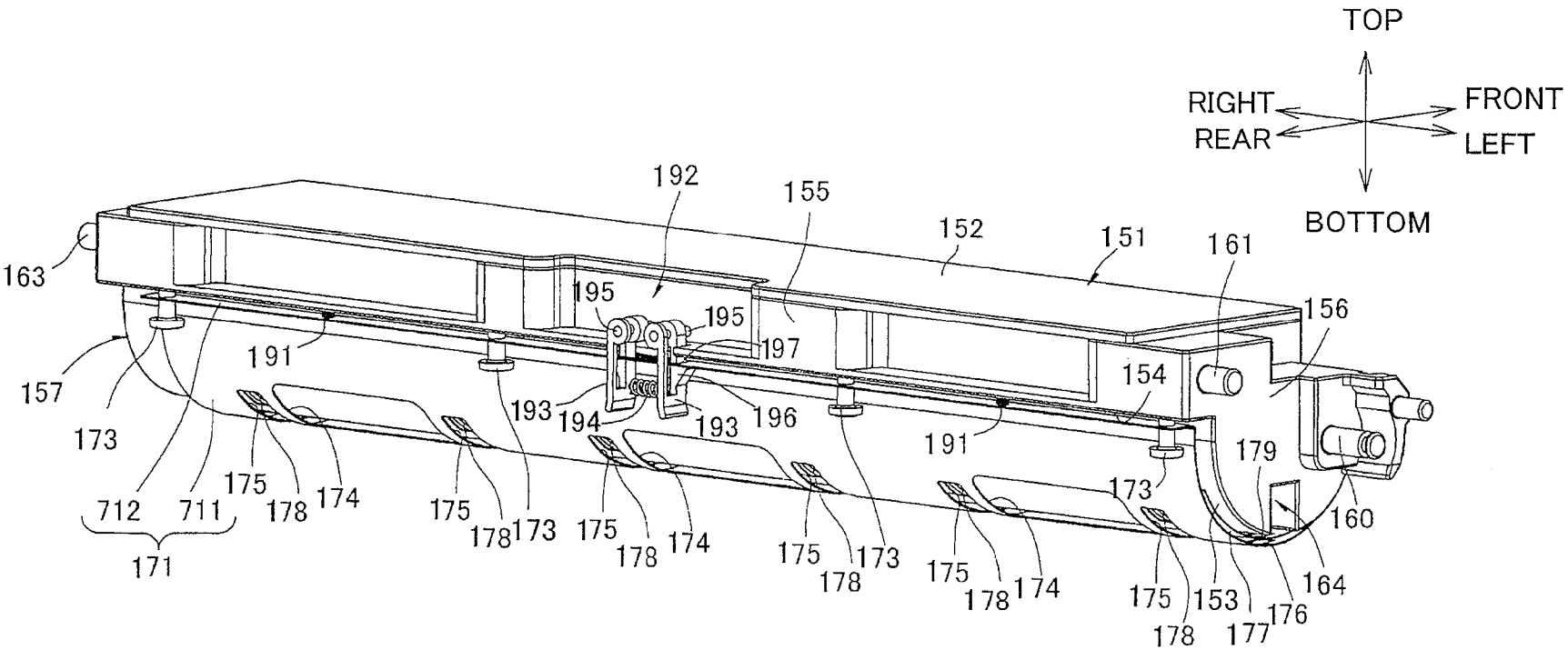
FIG. 19A is a perspective view illustrating the toner cartridge from a left rear view when the shutter cover is at a second position.

As shown in FIG. 19A, a locking member insertion hole 176 is also formed in the curved part 711 at a position corresponding to the recessed part 164 formed in the case 151.

(4) Shutter

As shown in FIG. 16, a shutter 177 is disposed between the arcing surface 153 and the shutter cover 171. The shutter 177 can move along the arcing surface 152 between an open position and a closed position. The shutter 158 is formed of a resin film that is curved to conform to the arcing surface 153. The shorter dimension (circumferential dimension) of the shutter 177 along the arcing surface 153 is greater than the same dimension of the toner seal 55, while the left-to-right dimension (width) of the shutter 177 is slightly smaller than the left-to-right dimension of the arcing surface 153.

As shown in FIG. 19A, two shutter drive openings 178 are formed in the shutter 177 at positions opposing each guide slit 175 in the shutter cover 171. The two shutter drive openings 178 are separated by a prescribed interval in the circumferential direction of the shutter 177.

When the shutter 177 is in the open position, the rear edge of the shutter 177 is positioned farther forward than the front edges of the seal openings 56 formed in the toner seals 55. Therefore, the through-holes 158 and the seal openings 56 are open and in communication with each other, providing communication between the interior and exterior of the case 151.

In the closed position, on the other hand, the shutter 177 is positioned farther rearward than in the open position. When the shutter 177 is in the closed position, the rear edge of the shutter 177 is positioned slightly rearward than the rear edges of the seal openings 56. Accordingly, the shutter 58 covers the through-holes 158 and the seal openings 56 in their entirety, blocking communication between the interior and exterior of the case 51.

As shown in FIG. 19A, a locking opening 179 is formed in the shutter 177 at a position corresponding to the recessed part 164 of the case 151 when the shutter 177 is in the closed position. Accordingly, when the shutter 177 is in the closed position, the locking opening 179 opposes the recessed part 164 and confronts the locking member insertion hole 176 formed in the shutter cover 171. Hence, the recessed part 164 and the locking member insertion hole 176 are in communication via the locking opening 179.

(5) Urging Members

As shown in FIGS. 18A and 19A, urging members 191 configured of compression coil springs are disposed between the fixing surface 154 and the flat part 712 at two symmetrical positions about the left-to-right center of the fixing surface 154. The urging members 191 urge the flat part 712 away from the fixing surface 154.

(6) Operating Member

An operating member 192 is provided on the toner cartridge 11. The operating member 192 includes a pair of pivoting members 193 separated from each other in the left-to-right direction, and a spring 194 interposed between the pair of pivoting members 193.

The pivoting members 193 are shaped symmetrical to each other in the left-to-right direction. Each pivoting member 193 has a squared C-shape in a side view and is open on the top. The free top ends of the pivoting member 193 are cylindrical and have a through-hole penetrating the ends in the front-to-rear direction. Two pivoting shafts 195 are provided in the left-to-right center region of the rear surface 155 of the case 151. The pivoting shafts 195 are separated in the left-to-right direction and extend rearward. One pivoting shaft 195 is loosely fitted into the free ends of each pivoting member 193. Through this construction, the pivoting members 193 are pivotably supported on the pivoting shafts 195, enabling the bottom ends of the pivoting members 193 to approach and separate from each other.

An engaging protrusion 196 is formed in the vertical center region of each pivoting member 193. The engaging protrusions 196 are triangular-shaped in a rear side view and protrude outward from the respective pivoting members 193.

A pivoting member insertion hole 197 is formed in the left-to-right center region of the flat part 712 of the shutter cover 171. The pivoting member insertion hole 197 is rectangular in shape and elongated in the left-to-right direction. The pivoting members 193 are inserted in the pivoting member insertion hole 197, but do not contact the edges of the pivoting member insertion hole 197.

The spring 194 urges the lower ends of the pivoting members 193 in a direction away from each other.

(7) Position of the Shutter Cover

When as shown in FIG. 18A the pivoting members 193 are inserted in the pivoting member insertion hole 197 without contacting the same, the flat part 712 urged by the elastic force of the urging members 191 contacts the inner sides of the heads of the screws 173 from above, as shown in FIG. 18A and 6B. At this time, the shutter cover 171 is in a first position in which the curvature radius of the curved part 711 is relatively large and the compression of the toner seals 55 interposed between the shutter 177 and the arcing surface 153 is relatively small. In this state, the engaging protrusions 196 are in a release position.

Figure 19B:
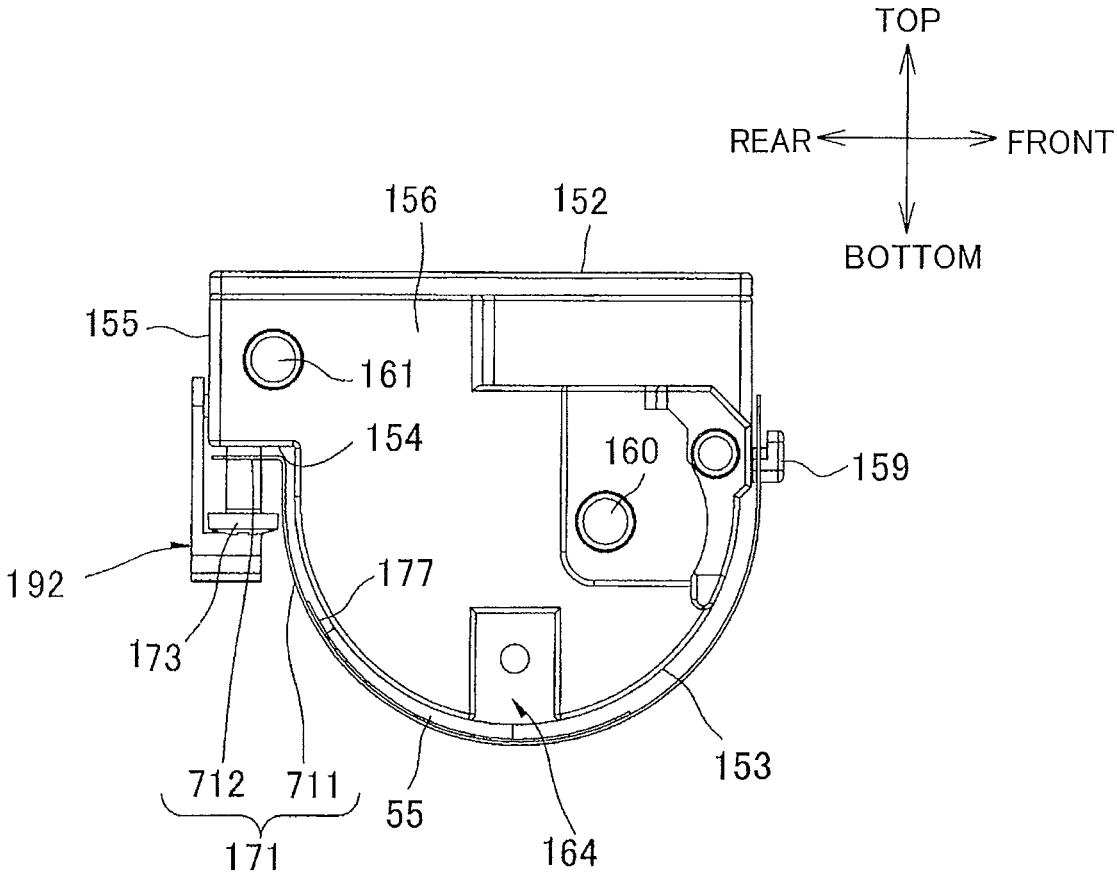
FIG. 19B is a left side view of the toner cartridge.

When as shown in FIGS. 19A and 19B the shutter cover 171 moves from this first position so that the flat part 712 approaches the fixing surface 154 against the urging force of the urging members 191, the curvature radius of the curved part 711 decreases and the compression of the toner seals 55 increases. When the pivoting member insertion hole 197 rises to a position above the engaging protrusions 196, the urging force of the spring 194 pushes the lower ends of the pivoting members 193 apart so that the engaging protrusions 196 confront the bottom of the flat part 712 in parts on left and right sides of the pivoting member insertion hole 197, respectively. When the force for moving the flat part 712 toward the fixing surface 154 is released in this state, the flat part 712 contacts and engages with the engaging protrusions 196. As a result, the shutter cover 171 is positioned and held in a second position in which the curvature radius of the curved part 711 is relatively small, and the compression of the toner seals 55 interposed between the shutter 177 and the arcing surface 153 of the case 151 is relatively high. That is, the curvature radius of the curved part 711 with the shutter cover 171 being in the second position is smaller than the curvature radius of the curved part 711 with the shutter cover 171 being in the first position and the compression of the toner seals 55 interposed between the shutter 177 and the arcing surface 153 of the case 151 with the shutter cover being in the second position is higher than the compression of the toner seals 55 with the shutter cover 171 being in the first position. In this state, the engaging protrusions 196 are in a restricting position. The cover openings 174 are formed in the curved part 711 at positions corresponding to the toner seals 55 irrespective a position of the shutter cover 171 between the first position and the second position.

2-5. Drive Transmission Mechanism

A drive transmission mechanism is provided in the drawer frame 31 for each of the shutter drive members 47. Each of the drive transmission mechanisms functions to move the corresponding shutter drive member 47 and the shutter 177.

Although not shown in the drawings, four operating levers are provided on the outer side (right side) of the right side plate 33 at positions corresponding to the four spaces 12. Four pivoting shafts 101 (see FIG. 16) are disposed in the drawer frame 31 at regular intervals in the front-to-rear direction. The pivoting shafts 101 extend in the left-to-right direction, spanning between the side plates 32 and 33.

As shown in FIG. 16, each drive transmission mechanism includes pinion gears 102 mounted on both ends of the pivoting shaft 101. The pinion gears 102 are engaged in the left and right rack gears 48 of the shutter drive member 47.

When the operating lever (not shown) is pivoted, causing the pivoting shaft 101 to rotate, the pinion gears 102 also rotate and transmit a drive force to the rack gears 48. Consequently, the shutter drive member 47 is moved along the partitioning wall 42 in a forward or rearward direction, shifting the shutter drive member 47 and the shutter 177 between the open position and the closed position.

2-6. Mounting and Removing a Toner Cartridge

The toner cartridge 11 is mounted in or removed from the corresponding space 12 in the drawer frame 31 from above, while the drawer unit 3 (drawer frame 31) has been pulled out of the main casing 2 to the withdrawn position shown in FIG. 14. Note the action of mounting the toner cartridge 11 in the space 12 may also be described as mounting the toner cartridge 11 in the developing unit 7 or the developing unit frame 8.

When the toner cartridge 11 is separated from the drawer unit 3, the shutter 177 of the toner cartridge 11 is in the closed position and the shutter cover 171 is in the second position.

To mount the toner cartridge 11 in the corresponding space 12, the operator inserts the support protrusions 162 and 163 of the toner cartridge 11 (see FIG. 17) into the top ends of the support grooves 36 and 37 formed in the right side plate 33 (see FIG. 15). In addition, the operator inserts the support protrusions 160 and 161 of the toner cartridge 11 (see FIG. 17) into the top ends of support grooves (not shown) formed in the left side plate 32. Next, the operator moves the toner cartridge 11 downward until the support protrusions 162 and 163 arrive at the deepest parts of the support grooves 36 and 37 and the support protrusions 160 and 161 arrive at the deepest parts of the corresponding support grooves (not shown). At this time, the toner cartridge 11 is properly mounted in the space 12 and supported in the drawer frame 31. When the toner cartridge 11 is in the mounted state, shutter drive protrusions 49 on the shutter drive member 47 are inserted into shutter drive openings (not shown) through the corresponding guide slits 175 formed in the shutter cover 171, thereby coupling the shutter 177 and shutter drive member 47.

Figure 20A:
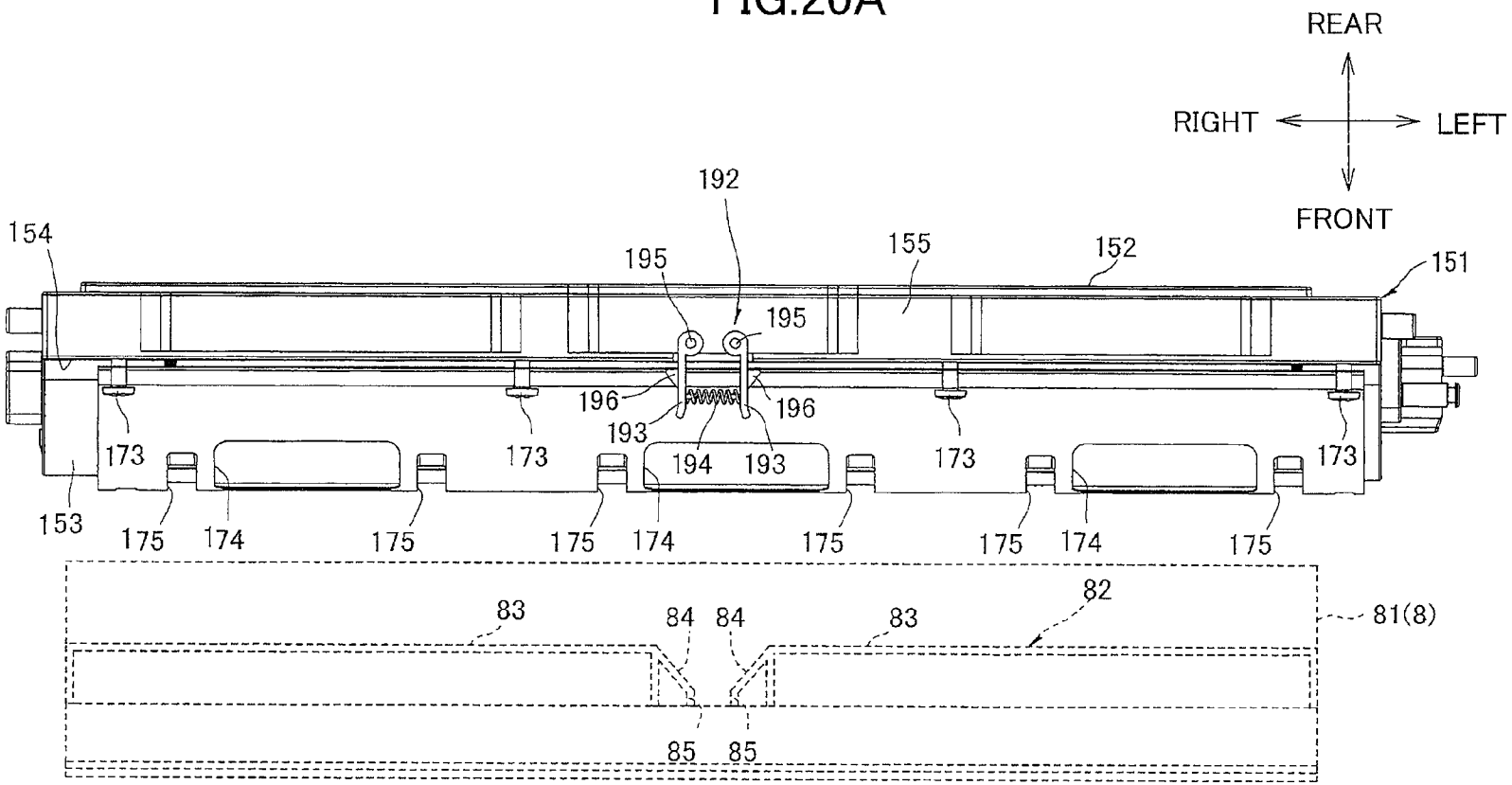
FIG. 20A is a rear view illustrating the drawer frame and the toner cartridge when starting an mounting operation of the toner cartridge to the drawer frame.
Figure 20B:
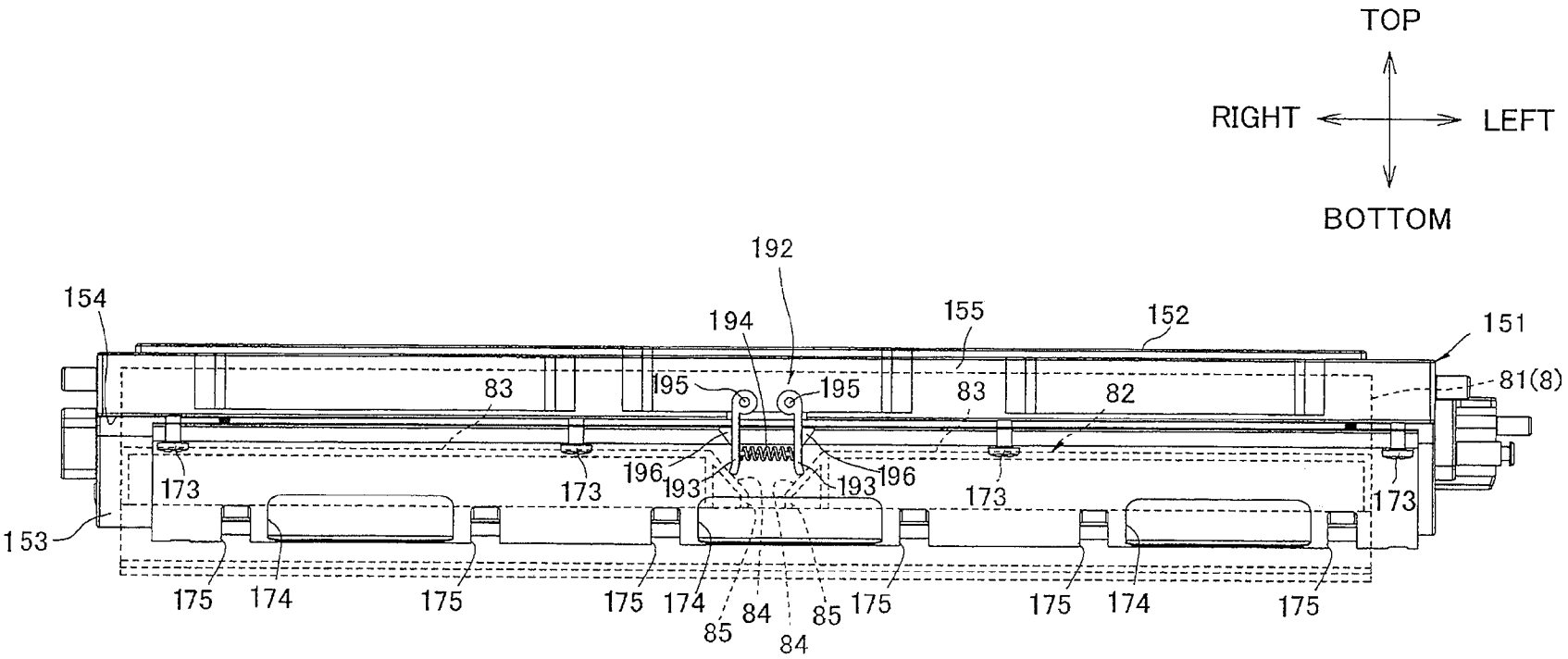
FIG. 20B is a rear view of the drawer frame and the toner cartridge during the mounting operation of the toner cartridge to the drawer frame.
Figure 20C:
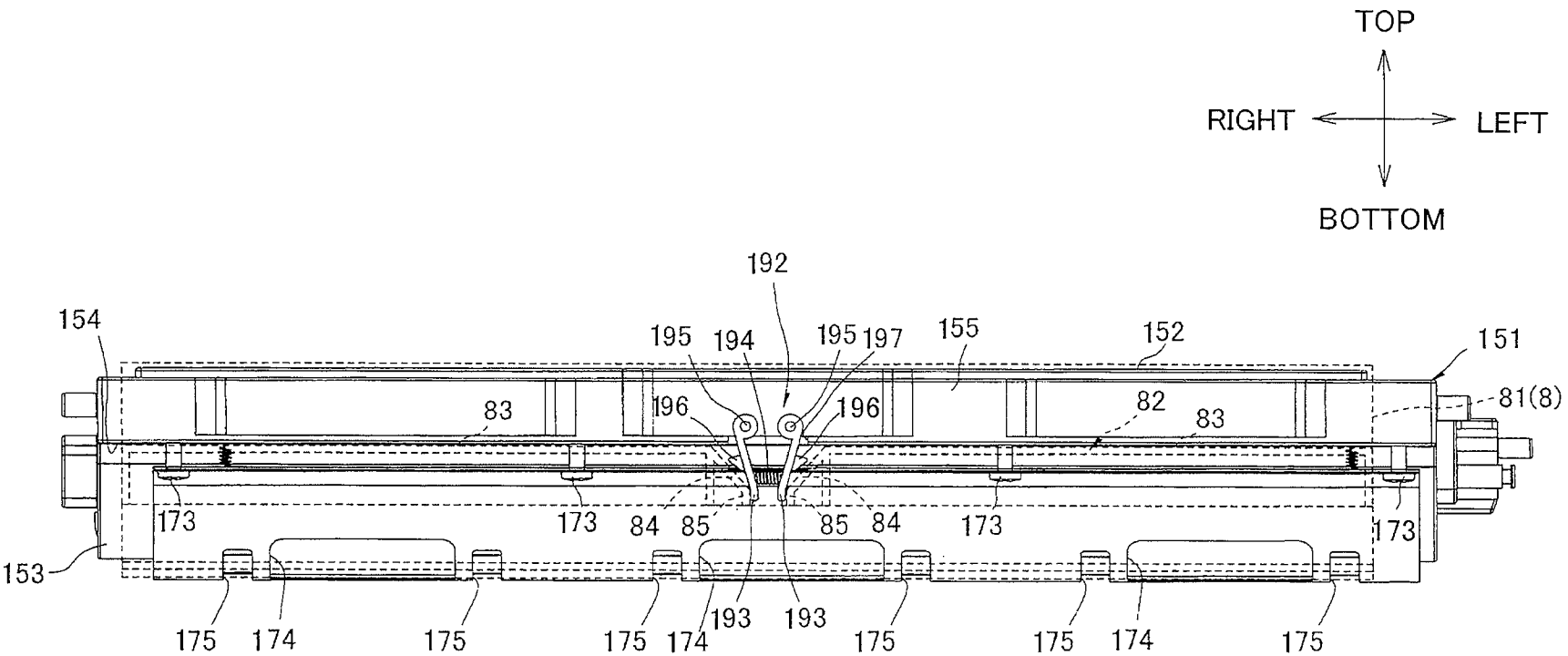
FIG. 20C is a rear view illustrating the drawer frame and the toner cartridge when the mounting operation of the toner cartridge to the drawer frame is finished.

During the process of mounting the toner cartridge 11 in the space 12, the operating member 192 of the toner cartridge 11 is positioned above the two sloped parts 84 of the operating member guide rib 82, as shown in FIG. 20A. As the toner cartridge 11 moves downward, the bottom ends of the left and right pivoting members 193 contact the respective left and right sloped parts 84, as shown in FIG. 20B. As the toner cartridge 11 continues to move downward, the bottom ends of the pivoting members 193 slide downward along the sloped parts 84, the sloped parts 84 forcing the bottom ends of the pivoting members 193 toward each other against the urging force of the spring 194. When the toner cartridge 11 is completely mounted in the space 12, the bottom ends of the pivoting members 193 are positioned between the two vertical parts 85 of the operating member guide rib 82, as shown in FIG. 20C. Consequently, the pivoting members 193 are once again inserted in the pivoting member insertion hole 197 without contacting the same, and the shutter cover 171 is returned to the first position by the urging force of the urging members 191.

When removing the toner cartridge 11 from the space 12, on the other hand, the flat part 712 of the shutter cover 171 in the first position is manually lifted toward the fixing surface 154 of the case 151 against the urging force of the urging members 191. This operation positions the pivoting member insertion hole 197 formed in the flat part 712 above the engaging protrusions 196 of the pivoting member 193, thereby relieving the force required for maintaining the flat part 712 adjacent to the fixing surface 154. As a result, the flat part 712 contacts and engages with the engaging protrusions 196, holding the shutter cover 171 in the second position.

2-7. Locking Mechanism

Since the shutter drive protrusions 49 are not engaged in the shutter drive openings of the shutter 177 when the toner cartridge 11 has been removed from the drawer unit 3, the shutter 177 can move freely relative to the case 151 and the shutter cover 171. Therefore, if the toner cartridge 11 were jolted, shaken, or the like, the shutter 177 could be moved unintentionally out of the closed position.

Figure 21A:
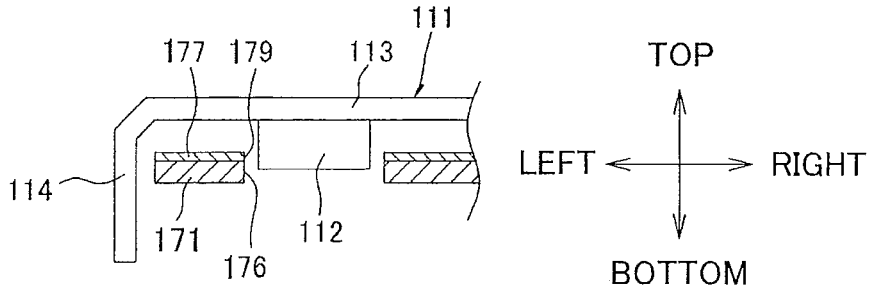
FIG. 21A is a cross section illustrating a locking mechanism formed in a recessed part when the shutter is fixed by the locking mechanism.
Figure 21B:
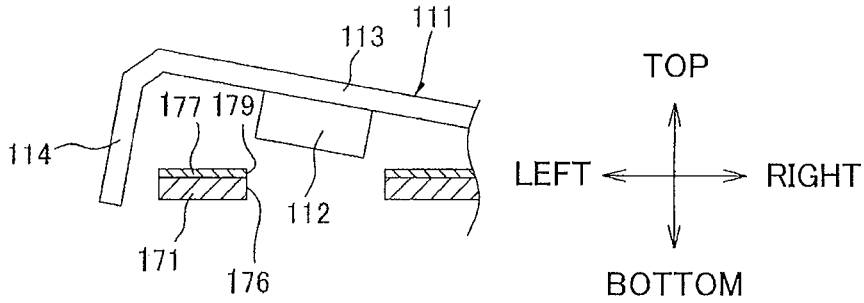
FIG. 21B is a cross section is a cross section illustrating the locking mechanism when the shutter is released.

In order to fix the shutter 177 in the closed position while the toner cartridge 11 is removed from the drawer unit 3, the toner cartridge 11 in the second embodiment is provided with a locking mechanism in the recessed part 164, as shown in FIGS. 21A and 21B.

As shown in FIGS. 21A and 21B, the locking mechanism includes an arm 111 formed on the case 151, and a locking protrusion 112 attached to the arm 111.

The arm 111 is configured of a flexible thin plate, such as a leaf spring. The arm 111 is L-shaped, extending leftward within the recessed part 164, then bending at a right angle and extending downward. More specifically, the arm 111 is integrally formed of a holding part 113 extending leftward within the recessed part 164, and a contact part 114 extending downward from the left end of the holding part 113.

The locking protrusion 112 has a flattened square pillar shape and is fixed to the bottom surface of the holding part 113. When the shutter 177 is in the closed position, the locking protrusion 112 on the bottom surface of the holding part 113 is disposed at a position opposing the locking opening 179 formed in the shutter 177. The downmost end of the contact part 114 is lower than the downmost surface of the locking protrusion 112.

Accordingly, when the toner cartridge 11 has been removed from the drawer unit 3, the locking protrusion 112 of the locking mechanism is inserted into the locking opening 179 of the shutter 177 and the locking member insertion hole 176 of the shutter cover 171, as shown in FIG. 21A, thereby preventing the shutter 177 from moving out of the closed position. Accordingly, the locking mechanism prevents the shutter 177 from moving out of the closed position while the toner cartridge 11 is removed from the drawer unit 3.

When the toner cartridge 11 is mounted in a corresponding space 12 provided in the drawer unit 3, as shown in FIG. 21B the bottom edge of the contact part 114 contacts the top surface of the shutter drive member 47 (FIG. 16) during the mounting operation. As the toner cartridge 11 moves further downward, the force of resistance that the contact part 114 receives from the shutter drive member 47 causes the holding part 113 to deform, bending so that the left end of the holding part 113 rises. Consequently, the locking protrusion 112 is extracted from the locking opening 179 and the locking member insertion hole 176. At this time, the shutter 177 can move freely relative to the case 151 and the shutter cover 171 and can move together with the shutter drive member 47.

2-8. Operations and Effects

The toner seals 55 are interposed between the case 151 and shutter 177 when the shutter 177 is in the closed position.

The shutter cover 171 is provided so that the shutter 177 and the toner seals 55 are interposed between the case 151 and shutter cover 171. While the shutter 177 is in the closed position, the shutter cover 171 can move between the first position and the second position.

When the shutter cover 171 is in the first position, the degree of compression of the toner seals 55 between the case 151 and the shutter 177 is relatively small, and the sealing pressure of the toner seals 55 is relatively low. Hence, placing the shutter 177 in the first position can reduce the amount of torque required to move the shutter 177 between the open position and the closed position.

However, when the shutter 177 is in the second position, the degree of compression in the toner seals 55 is relatively large, and the sealing pressure is relatively high. Accordingly, placing the shutter 177 in the second position can reliably prevent toner from leaking between the case 151 and the shutter 177 when transporting the toner cartridge 11.

Hence, the above construction can reduce the amount of torque required for moving the shutter 177 while preventing toner leakage during transport of the toner cartridge 11.

The urging members 191 are interposed between the case 151 and the shutter cover 171 for urging the shutter cover 171 toward the first position. Accordingly, the urging force of the urging members 191 maintains the shutter cover 171 in the first position while an external force is not applied to the shutter cover 171. The shutter cover 171 can be moved to the second position by pressing the shutter cover 171 against the urging force of the urging members 191.

The shutter cover 171 can be moved from the first position to the second position through the operation of the operating member 192.

The shutter 177 is interposed between the case 151 and the shutter cover 171 and is capable of moving in a circumferential direction along the arcing surface 153 of the case 151 and the curved part 711 of the shutter cover 171. This construction minimizes the space required for moving the shutter 177 between the open position and the closed position.

The curved part 711 has a smaller radius of curvature when the shutter cover 171 is in the second position than when the shutter cover 171 is in the first position. Hence, the shutter cover 171 can be moved from the first position to the second position by deforming the curved part 711 so that the curved part 711 has a smaller radius of curvature. Conversely, the shutter cover 171 can be moved from the second position to the first position by deforming the curved part 711 so that the curved part 711 has a larger radius of curvature. With this construction, the degree of compression in the toner seals 55 can be increased simply by lifting the edge of the shutter cover 171, modifying the degree of compression across the entire surface of the toner seals 55 uniformly.

One circumferential edge of the shutter cover 171 is fixed to the case 151, while the opposite edge is movably disposed relative to the case 151. Hence, the shutter cover 171 can easily be moved between the first and second positions for modifying the radius of curvature in the curved part 711 simply by shifting the movable circumferential edge of the shutter cover 171.

Further, the toner cartridge 11 is provided with the engaging protrusions 196 for restricting movement of this movable edge of the shutter cover 171. By restricting the movement of the movable edge, the shutter cover 171 can be maintained in the second position.

Since the engaging protrusions 196 are provided in the operating member 192, operation of the operating member 192 can displace the engaging protrusions 196 between the restricting position for restricting movement of the movable edge of the shutter cover 171, and the release position for releasing this restriction. Hence, there is no need to perform separate operations for the operating member 192 and the engaging protrusions 196, thereby improving the efficiency of operations for moving the shutter cover 171.

The case 151 is elongated in a direction following the central axis of the arcing surface 153, and the two engaging protrusions 196 are separated from each other in the longitudinal direction of the case 151. Accordingly, the restricting effect of the engaging protrusions 196 for restricting movement of the second edge of the shutter cover 171 is balanced along the longitudinal direction of the case 151.

The cover openings 174 are formed in the shutter cover 171 at positions corresponding to the through-holes 158. Hence, when the shutter 177 is in the open position and the through-holes 158 are open, toner can be discharged from the case 151 through the through-holes 158 and the cover openings 174.

The shutter 177 is flexible and, thus, can be deformed when the shutter cover 171 moves between the first position and the second position. Therefore, the shutter 177 can reliably close the through-holes 158, regardless of the position of the shutter cover 171.

The locking protrusion 112 formed on the case 151 protrudes toward the shutter 177, and the locking opening 179 is formed in the shutter 177 at a position corresponding to the locking protrusion 112. The locking protrusion 112 is engaged in the locking opening 179 when the shutter 177 is in the closed position, thereby preventing the shutter 177 from moving out of the closed position. Accordingly, this structure reliably prevents movement of the shutter 177 while the toner cartridge 11 is being transported or the like, and can reliably prevent toner from leaking out of the toner cartridge 11.

The drawer frame 31 is provided with an operating member guide rib 82 for each of the toner cartridges 11. The operating member guide rib 82 contacts the corresponding operating member 192 when the toner cartridge 11 is mounted in the drawer frame 31 and actuates the operating member 192 during the mounting operation. Hence, the operating member 192 is actuated when the toner cartridge 11 is mounted in the drawer frame 31, moving the shutter cover 171 from the first position to the second position. Since the operator does not need to actuate the operating member 192 directly, this construction achieves a laser printer having superior ease of operations.

[Variations of Second Embodiment]

2-9. Toner Cartridge

Figure 22:
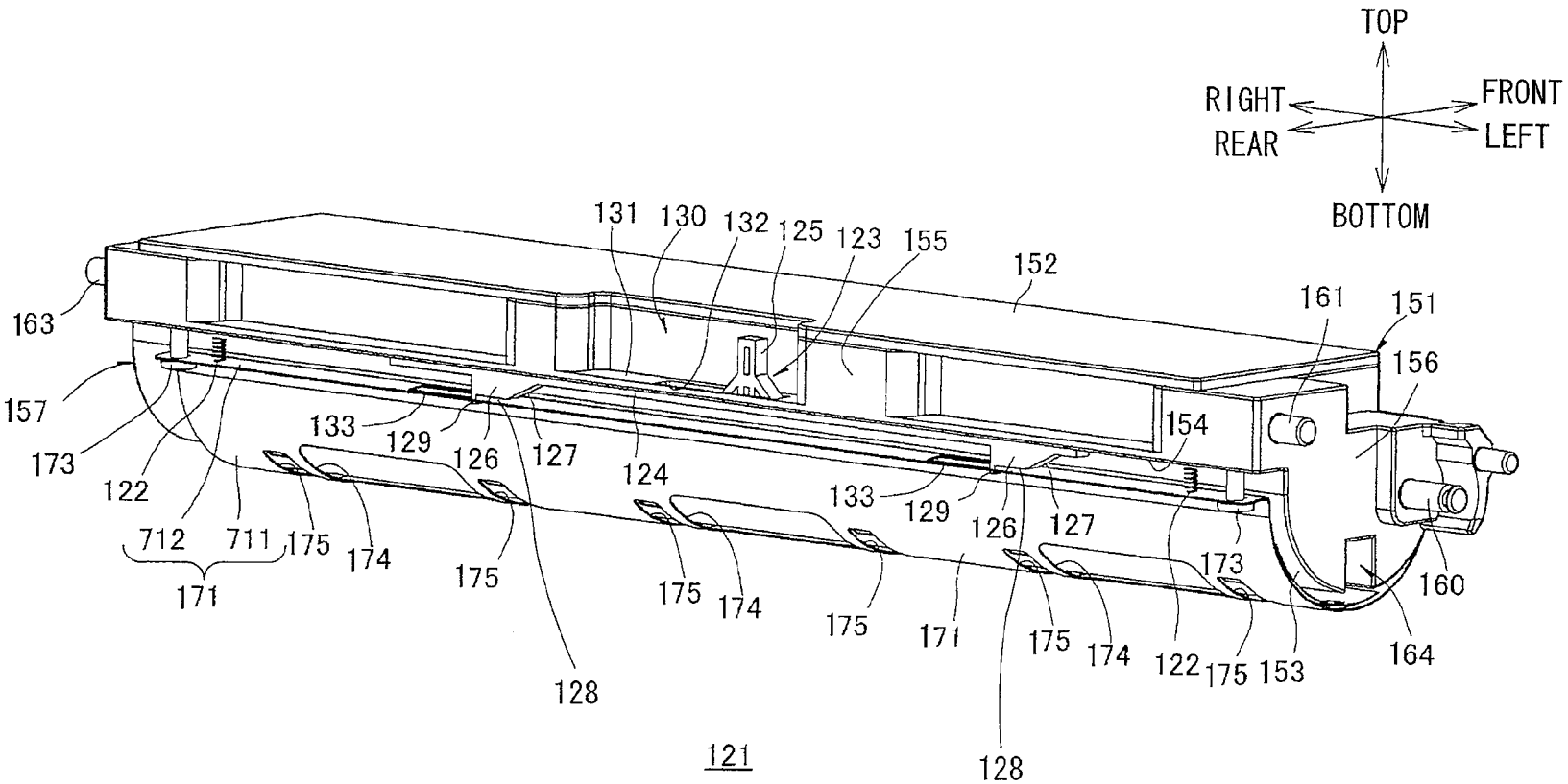
FIG. 22 is a perspective view illustrating a toner cartridge according to a variation of the second embodiment from a left rear view when a shutter cover is at a first position.
Figure 23:
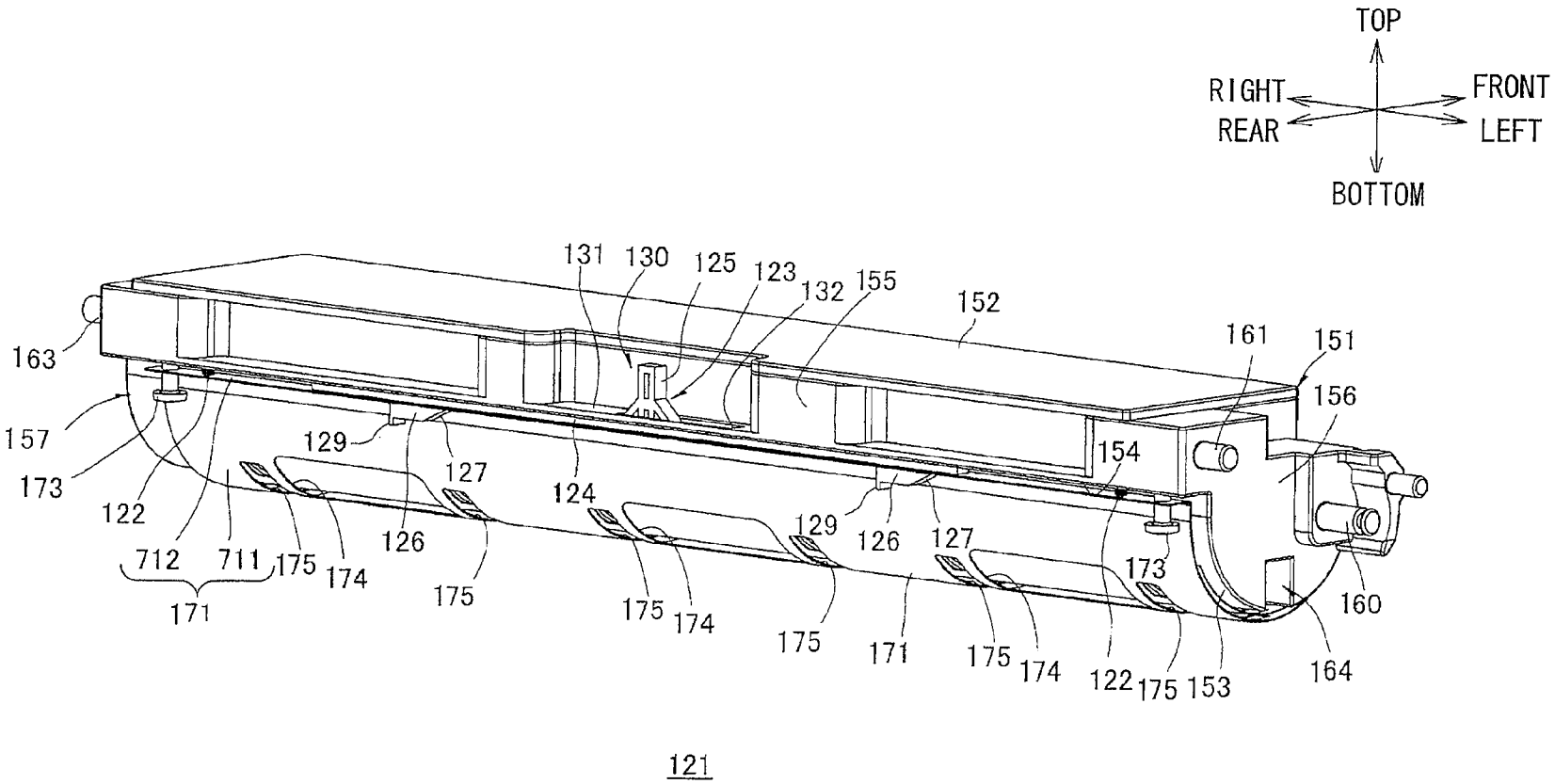
FIG. 23 is a perspective view illustrating a toner cartridge according to a variation of the second embodiment from a left rear view when a shutter cover is at a second position.

FIGS. 22 and 23 show a toner cartridge 121 according to a Variation of the Second Embodiment.

The toner cartridges 121 can be mounted in and removed from the drawer frame 31 (the spaces 12) in place of the toner cartridges 11 shown in FIG. 18A. In the following description, only the structure of the toner cartridge 121 that differs from that of the toner cartridge 11 shown in FIG. 18A will be described, wherein like parts and components are designated with the same reference numerals to avoid duplicating description.

(1) Urging Members

Urging members 122 configured of tension springs are disposed between the fixing surface 154 of the case 151 and the flat part 712 of the shutter cover 171 at two symmetrical positions about the left-to-right center of the fixing surface 154. The urging members 122 urge (pulls) the flat part 712 toward the fixing surface 154.

(2) Operating Member

Figure 24:
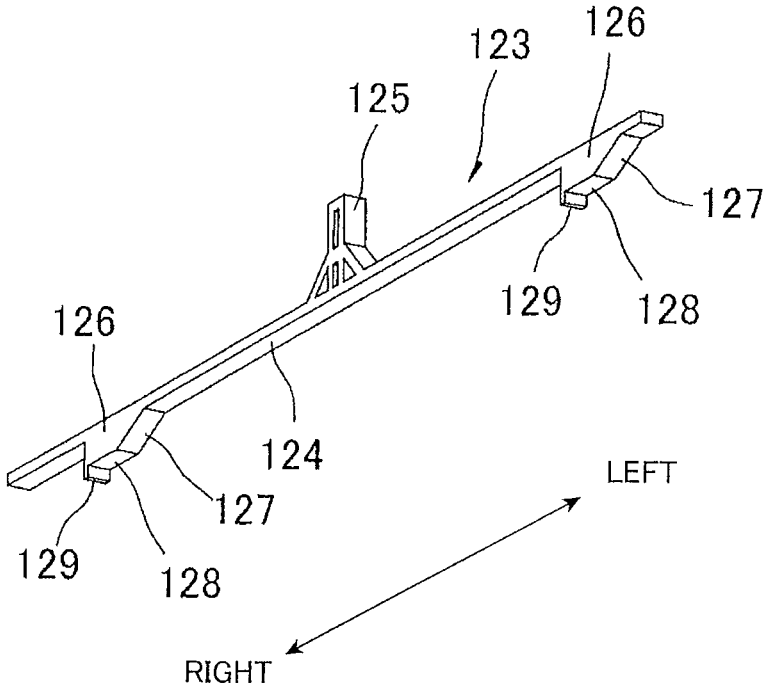
FIG. 24 is a perspective view of an operating member.

An operating member 123 is provided on the toner cartridge 121. As shown in FIG. 24, the operating member 123 includes a slender rectangular plate-shaped main part 124 extending in the left-to-right direction, a knob part 125 erected from the top surface of the main part 124 at a position in the center thereof in the left-to-right direction, and two engaging parts 126 formed on the bottom surface of the knob part 125 at two positions separated in the left-to-right direction.

Each engaging part 126 has a trapezoidal shape in a rear side view formed by a sloped surface 127 sloping downward to the right, and a parallel surface 128 extending rightward from the right edge (bottom edge) of the sloped surface 127 and parallel to the top surface of the main part 124. A thin plate-shaped stopper 129 is formed across the entire right edge of the parallel surface 128 and protrudes downward therefrom.

As shown in FIGS. 22 and 23, a recessed part 130 is formed in the center region of the rear surface 155 recessed frontward. The bottom of the recessed part 130 is defined by the top surface of a thin plate part 131 whose bottom surface serves as the fixing surface 154. A through-hole 132 is formed in a center region of the thin plate part 131. The through-hole 132 is rectangular in shape and elongated in the left-to-right direction.

Two through-holes 133 separated in the left-to-right direction are formed in the flat part 712 of the shutter cover 171. The gap between the through-holes 133 is equivalent to the gap between the engaging parts 126. The center portion of the flat part 712 between the through-holes 133 confronts the through-hole 132 from below.

The operating member 123 is disposed between the fixing surface 154 of the case 151 and the flat part 712 of the shutter cover 171, with the knob part 125 inserted through the through-hole 132 from below.

(3) Position of the Shutter Cover

When as shown in FIG. 22 the two engaging parts 126 are positioned on the left sides of the corresponding through-holes 133 and the parallel surfaces 128 of these engaging parts 126 are in contact with the flat part 712, the shutter cover 171 is in the first position in which the curvature radius of the curved part 711 is relatively large and the compression of the toner seals 55 interposed between the shutter 177 and the arcing surface 153 is relatively small. In this state, the engaging parts 126 are in the restricting position.

If the operator manually moves the knob part 125 rightward from this state, the engaging parts 126 are moved to positions above the through-holes 133, and the urging force of the urging members 122 pulls the flat part 712 toward the fixing surface 154 so that the engaging parts 126 are fitted into the corresponding through-holes 133. Through this operation, the shutter cover 171 moves from the first position into the second position in which the curvature radius of the curved part 711 is relatively small and the compression of the toner seals 55 is greater. In this state, the engaging parts 126 are in the release position.

From this state, if the operator manually moves the knob part 125 leftward, the sloped surfaces 127 of the engaging parts 126 slide against the left edges of the respective through-holes 133, applying a force to the flat part 712 for pushing the flat part 712 downward and away from the fixing surface 154. As the operating member 123 is moved farther leftward, the parallel surfaces 128 of the engaging parts 126 contact the flat part 712. At this point, the shutter cover 171 has completed its shift from the second position to the first position. As the operating member 123 is moved farther leftward, the stoppers 129 contact the left edges of the respective through-holes 133, restricting further movement of the operating member 123.

Accordingly, the toner cartridge 121 shown in FIGS. 22 and 23 used in place of the toner cartridge 11 shown in FIG. 18A can still prevent toner from leaking during transport while reducing the torque required for operating the shutter 177.

Other Variation of the Second Embodiment

Figure 25A:
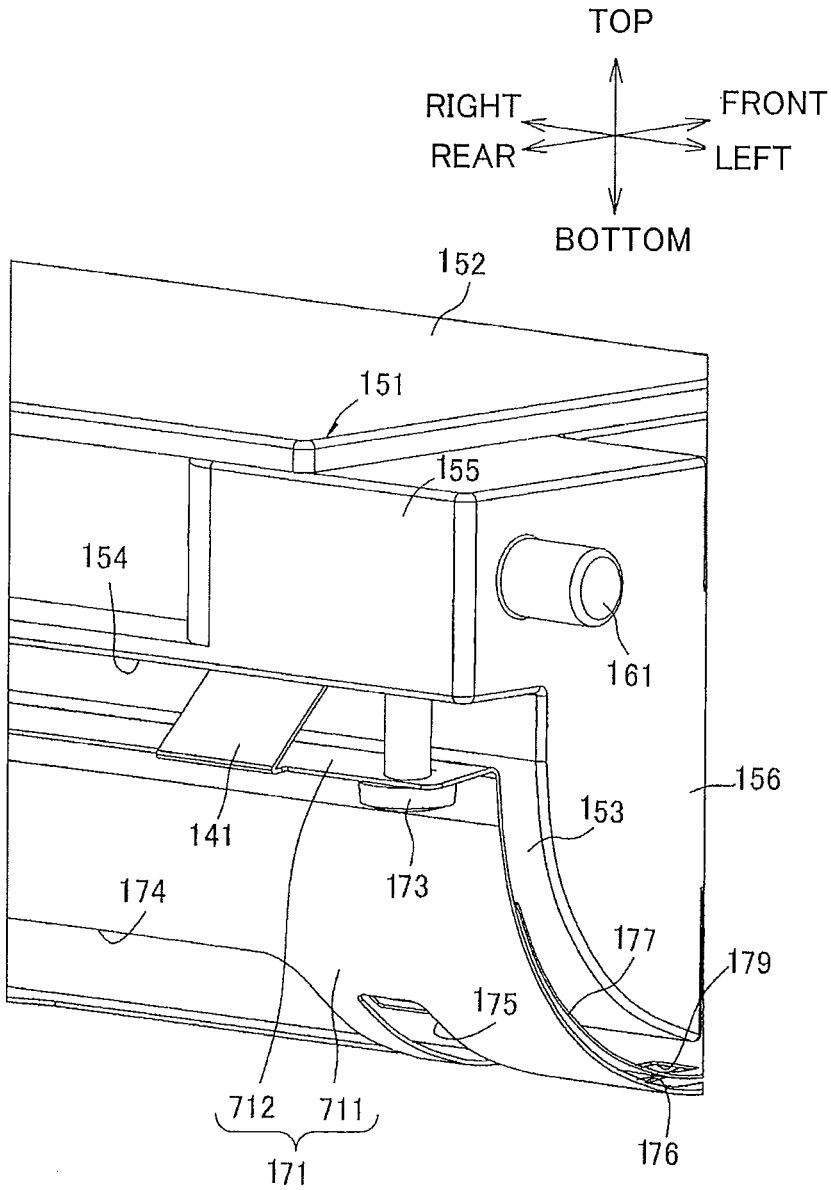
FIG. 25A is an enlarged perspective view illustrating a toner cartridge according to another variation of the second embodiment when the shutter cover is at a first position.
Figure 25B:
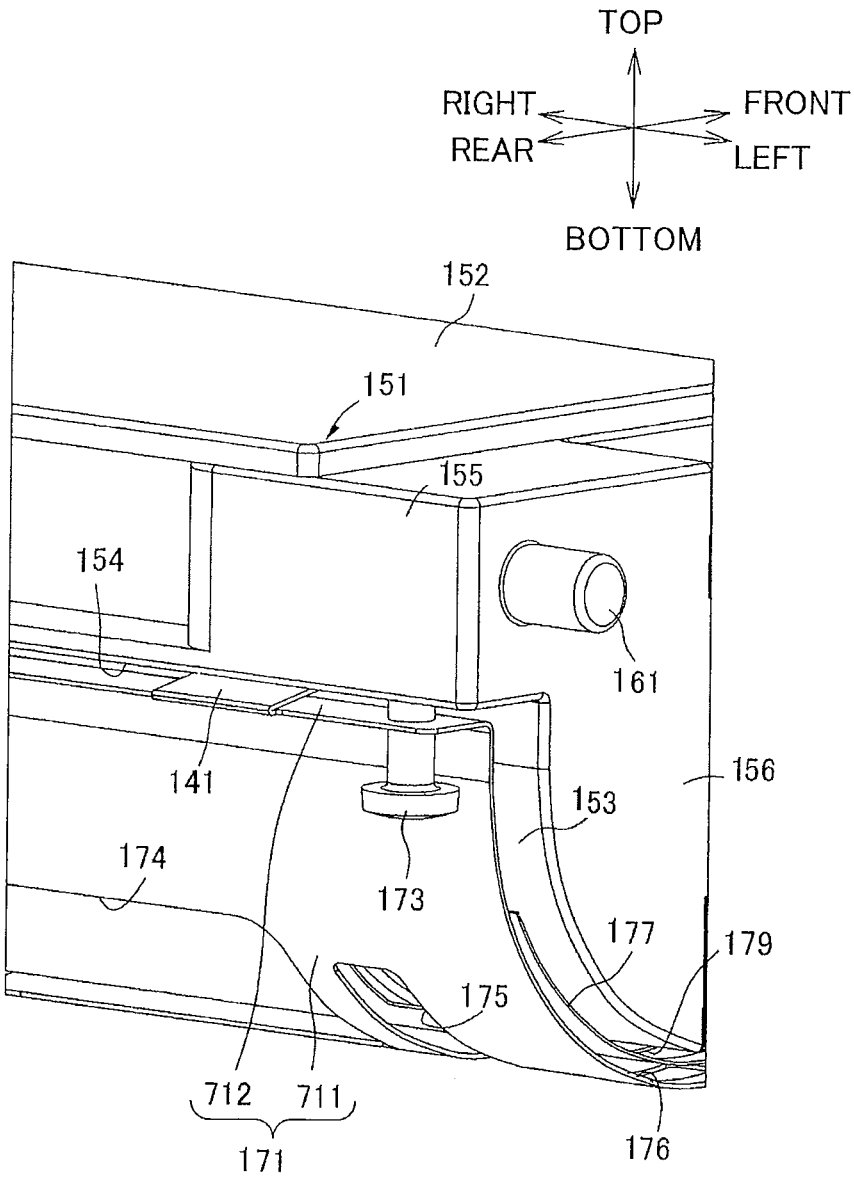
FIG. 25B is an enlarged perspective view illustrating the toner cartridge according to another variation of the second embodiment when the shutter cover is at a second position.

While the toner cartridge 11 shown in FIG. 18A is provided with urging members 191 configured of compressed coil springs, urging members 141 configured of leaf springs may be used in place of the urging members 191, as illustrated in FIGS. 25A and 25B. In this construction, the urging members 141 may be formed separate from the shutter cover 171 or may be formed integrally with the shutter cover 171. In the example shown in FIGS. 25A and 25B, the urging members 141 are formed integrally with the shutter cover 171 and are folded in the middle such that the lower portions extend rearward from the flat part 712 and the upper portions extends back toward the front while sloping upward. The distal edges of the urging members 141 contact the fixing surface 154 of the case 151.

While the invention is applied to a tandem-type color printer in the embodiments, the invention may also be applied to other types of color printers, as well as monochrome printers.

While the invention has been described in detail with reference to the embodiments thereof, it would be apparent to those skilled in the art that various changes and modifications may be made therein without departing from the scope of the invention.

What is claimed is:

1. A toner cartridge comprising:

a main casing accommodating therein toner and formed with an opening which provides communication between an interior and an exterior of the main casing;

a shutter movable along the main casing by an external driving force applied in a force direction between a closed position at which the shutter closes the opening and an open position at which the shutter opens the opening;

a toner seal formed with a seal opening opposing the opening of the main casing, and interposed between the main casing and the shutter when the shutter is positioned at the closed position; and a guide portion configured to guide a movement of the shutter in an inclined direction inclined with respect to the force direction wherein the main casing has an outer surface extending in a longitudinal direction and has an arcuate shaped portion having an arcuate shape in a cross-section taken along an imaginary plane orthogonal to the longitudinal direction, wherein the outer surface defines a circumferential direction, wherein the force direction is in conformance with the circumferential direction, and the inclined direction is inclined relative to the circumferential direction toward the longitudinal direction, and wherein the shutter moves in the inclined direction along the arcuate shaped portion.

2. The toner cartridge according to claim 1, further comprising a shutter cover configured to cover the shutter and positioned opposite to the main casing with respect to the shutter, and wherein the shutter cover is formed with a guide hole functioning as the guide portion; and wherein the shutter has a guided portion movable in the inclined direction along the guide hole.

3. The toner cartridge according to claim 2, wherein the guide hole has a first profile portion extending in the force direction and a second profile portion extending in the inclined direction.

4. A developing device comprising a toner cartridge, and a developing unit to which the toner cartridge is assembleable, the toner cartridge comprising:

a main casing accommodating therein toner and formed with an opening which provides communication between an interior and an exterior of the main casing;

a shutter having an engaged portion and movable along the main casing between a closed position at which the shutter closes the opening and an open position at which the shutter opens the opening;

a toner seal formed with a seal opening opposing the opening of the main casing, and interposed between the main casing and the shutter when the shutter is positioned at the closed position; and a shutter cover configured to cover the shutter and positioned opposite to the main casing with respect to the shutter, the shutter cover being formed with a guide hole having an inclined portion; and the developing unit comprising a shutter drive member configured to move the shutter between the open position and the closed position, and having an engaging portion engageable with the engaged portion, the engaging portion extending through the guide hole to engage the engaged portion and defining a direction of a force transmitted to the engaged portion, the inclined portion being inclined with respect to the direction of the force.

5. The developing device according to claim 4, wherein the guide hole further includes a parallel portion extending in a direction parallel to the direction of the force.

6. A developing device comprising a toner cartridge, and a developing unit to which the toner cartridge is assembleable, the toner cartridge comprising:

a main casing accommodating therein toner and formed with an opening which provides communication between an interior and an exterior of the main casing;

a shutter having an engaged portion and movable along the main casing between a closed position at which the shutter closes the opening and an open position at which the shutter opens the opening; and a toner seal formed with a seal opening opposing the opening of the main casing, and interposed between the main casing and the shutter when the shutter is positioned at the closed position; and the developing unit comprising:

a shutter drive member configured to move the shutter between the open position and the closed position, and having an engaging portion engageable with the engaged portion, the engaging portion defining a direction of a force transmitted to the engaged portion; and a guide member having an inclined portion in abutment with the shutter drive member to guide a movement of the shutter drive member in an inclined, direction inclined with respect to the direction of force, wherein the main casing has an outer surface extending in a longitudinal direction and has an arcuate shaped portion having an arcuate shape in a cross-section taken along an imaginary plane orthogonal to the longitudinal direction, wherein the outer surface defines a circumferential direction, wherein the direction of the force is in conformance with the circumferential direction, and the inclined direction is inclined relative to the circumferential direction toward the longitudinal direction, and wherein the shutter moves in the inclined direction along the arcuate shaped portion.

7. The developing device according to claim 6, wherein the guide member further includes a parallel portion that extends in the direction of the force.

8. A toner cartridge comprising:

a main casing accommodating therein toner and formed with an opening which provides communication between an interior and an exterior of the main casing;

a shutter configured to move between a closed position at which the shutter closes the opening and an open position at which the shutter opens the opening;

a toner seal interposed between the main casing and the shutter when the shutter is positioned at the closed position; and a shutter cover positioned opposite to the main casing with respect to the shutter for covering the shutter and movable between a first position and a second position while the shutter is at the closed position, the shutter cover compressing the toner seal toward the main casing, and providing, at the second position, a compression amount of the toner seal greater than that at the first position.

9. The toner cartridge according to claim 8, further comprising an urging member positioned between the main casing and the shutter cover to urge the shutter cover toward one of the first position and the second position.

10. The toner cartridge according to claim 9, wherein the urging member is a compression spring urging the shutter cover away from the main casing to urge the shutter cover to the first position.

11. The toner cartridge according to claim 9, wherein the urging member is a tension spring urging the shutter cover toward the main casing to urge the shutter cover to the second position.

12. The toner cartridge according to claim 8, further comprising an operation assembly to selectively move the shutter cover to one of the first position and the second position.

13. The toner cartridge according to claim 8, wherein the main casing has an outer surface in arcuate shape in a circumferential direction; and, wherein the shutter cover includes a curved portion curved to conform with the outer surface.

14. The toner cartridge according to claim 13, wherein the curved portion is resiliently deformable into one of a first profile providing a first radius of curvature at the first position and a second profile providing a second radius of curvature in the second position, the second radius of curvature being smaller than the first radius of curvature.

15. The toner cartridge according to claim 13, wherein the shutter cover has one end portion and another end portion in the circumferential direction, the one end portion being fixed to the main casing and the another end portion being movable relative to the main casing to selectively provide one of the first position and the second position.

16. The toner cartridge according to claim 15, further comprising a restrictive portion that restricts a movement of the another end portion to fix one of the first position and the second position.

17. The toner cartridge according to claim 16, further comprising an operation assembly to selectively move the shutter cover to one of the first position and the second position, the restrictive portion being provided at the operation assembly and movable between a restrictive position to restrict the movement of the another end portion and a release position for releasing the another end portion in accordance with the movement of the operation assembly.

18. The toner cartridge according to claim 16, wherein the main casing extends in a longitudinal direction, the outer surface having the arcuate cross-sectional shape taken along an imaginary plane orthogonal to the longitudinal direction; and wherein the restrictive portion comprises two restrictive members spaced away from each other in the longitudinal direction.

19. The toner cartridge according to claim 8, wherein the shutter cover is formed with a cover opening at a position in confrontation with the opening of the main casing.

20. The toner cartridge according to claim 8, wherein the shutter cover is resiliently deformable.

21. The toner cartridge according to claim 8, wherein the main casing has a protrusion protruding toward the shutter; and wherein the shutter is formed with a shutter opening engaged with the protrusion when the shutter is at the closed position.

22. An image-forming device comprising:

a main frame body defining an accommodation space;

a holder unit configured to move between an accommodated position at which the holder unit is accommodated in the accommodation space and a pulled-out position in which the holder unit is displaced from the accommodated position; and a toner cartridge mountable on the holder unit the toner cartridge comprising a main casing accommodating therein toner and formed with an opening which provides communication between an interior and an exterior of the main casing;

a shutter configured to move between a closed position at which the shutter closes the opening and an open position at which the shutter opens the opening;

a toner seal interposed between the main casing and the shutter when the shutter is positioned at the closed position; and a shutter cover positioned opposite to the main casing with respect to the shutter for covering the shutter and movable between a first position and a second position while the shutter is at the closed position, the shutter cover compressing the toner seal toward the main casing, and providing, at the second position, a compression amount of the toner seal greater than that at the first position.

23. The image-forming device according to claim 22, wherein the toner cartridge further comprises an operation assembly configured to be operated to move the shutter cover between the first position and the second position; and.

wherein the holder unit has a contact part that allows the operation assembly to be in contact therewith to operate the operation assembly when the toner cartridge is mounted onto the holder unit.

* * * * *